US007806477B2

(12) United States Patent
LaPointe et al.

(10) Patent No.: US 7,806,477 B2
(45) Date of Patent: Oct. 5, 2010

(54) FURNITURE MEMBER LUMBAR SUPPORT SYSTEM

(75) Inventors: Larry P. LaPointe, Temperance, MI (US); Mark D. McClung, Grandview, TN (US)

(73) Assignee: La-Z-Boy Incorporated, Monroe, MI (US)

( * ) Notice: Subject to any disclaimer, the term of this patent is extended or adjusted under 35 U.S.C. 154(b) by 208 days.

(21) Appl. No.: 12/040,021

(22) Filed: Feb. 29, 2008

(65) Prior Publication Data

US 2009/0218863 A1 Sep. 3, 2009

(51) Int. Cl.
*A47C 7/46* (2006.01)

(52) U.S. Cl. ..... 297/284.4

(58) Field of Classification Search ..... 297/452.21, 297/284.4, 312, 452.23, 452.46, 452.15, 297/452.63; 267/89
See application file for complete search history.

(56) References Cited

U.S. PATENT DOCUMENTS

| | | | | | |
|---|---|---|---|---|---|
| 3,081,077 | A * | 3/1963 | Sudman | 267/111 |
| 3,807,794 | A * | 4/1974 | Beyer | 297/284.4 |
| 4,148,522 | A * | 4/1979 | Sakurada et al. | 297/284.4 |
| 4,159,847 | A * | 7/1979 | Arai | 297/284.4 |
| 4,296,965 | A * | 10/1981 | Sakurada et al. | 297/284.4 |
| 4,660,887 | A * | 4/1987 | Fleming et al. | 297/448.2 |
| 4,725,095 | A * | 2/1988 | Benson et al. | 297/284.1 |
| 4,896,918 | A * | 1/1990 | Hoshihara | 297/284.4 |
| 4,968,093 | A * | 11/1990 | Dal Monte | 297/284.4 |
| 5,007,677 | A * | 4/1991 | Ozawa et al. | 297/284.4 |
| 5,087,098 | A * | 2/1992 | Ishizuka | 297/284.4 |
| 5,403,069 | A * | 4/1995 | Inara et al. | 297/284.4 |
| 5,588,703 | A * | 12/1996 | Itou | 297/284.4 |
| 5,711,577 | A * | 1/1998 | Whalen | 297/361.1 |
| 5,997,094 | A * | 12/1999 | Cvek | 297/452.15 |
| 6,402,246 | B1 * | 6/2002 | Mundell | 297/284.4 |
| 7,044,551 | B2 * | 5/2006 | Fujita et al. | 297/284.4 |
| 7,204,556 | B2 * | 4/2007 | Schwerdtner et al. | 297/378.12 |
| 2002/0135218 | A1 * | 9/2002 | Fujita et al. | 297/452.56 |
| 2005/0046251 | A1 * | 3/2005 | Foelster et al. | 297/253 |

* cited by examiner

*Primary Examiner*—Peter R. Brown
(74) *Attorney, Agent, or Firm*—Harness, Dickey & Pierce, P.L.C.

(57) ABSTRACT

A lumbar support system for a furniture member includes a furniture member having a back seat member connected to a base member. A lumbar support system is connected to the back seat member. The lumbar support system includes first and second pivot tubes rotatably connected to the back seat member. At least one flexible occupant lumbar support member is connected to each of the first and second pivot tubes. A lumbar support adjustment device connected to a predetermined one of the pivot tubes rotates the first pivot tube to selectively position the lumbar support members in any one of a plurality of support positions. A linkage set couples the support adjustment device to the first one of the first and second pivot tubes.

34 Claims, 27 Drawing Sheets

FIG 16
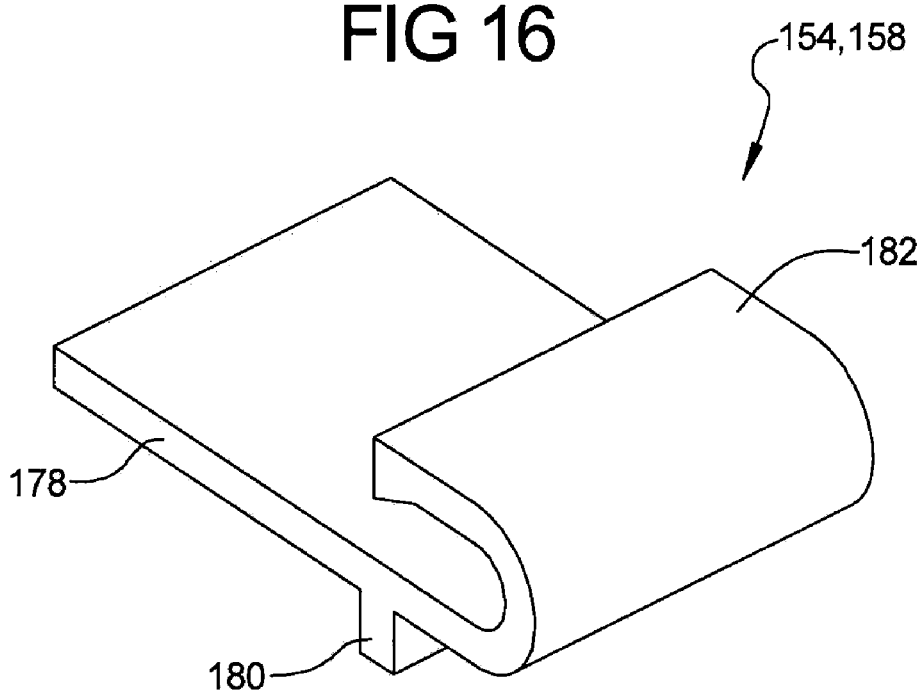
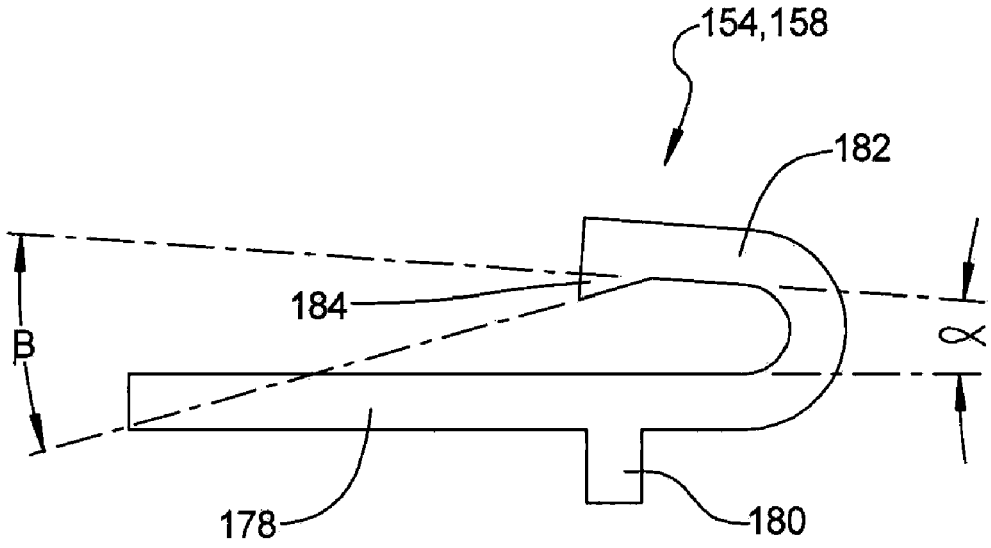
FIG 17

FURNITURE MEMBER LUMBAR SUPPORT SYSTEM

FIELD

The present disclosure relates to furniture members having mechanisms for positioning the furniture members in multiple operator selected positions.

BACKGROUND

The statements in this section merely provide background information related to the present disclosure and may not constitute prior art.

Conventionally, reclining articles of furniture (i.e., chairs, sofas, loveseats, and the like), referred to hereinafter generally as reclining chairs, utilize a mechanism to bias a leg rest assembly in extended and stowed positions and separate components to allow a back seat member to recline with respect to a seat base. Known furniture members can also include mechanism designs that also permit the reclining chair to rock in a front-to-back motion with respect to an occupant. Occupant lumbar support is commonly provided by one or more cushion members which abut with or are connected to a horizontally configured member such as a strap or similar flexible member. This member is commonly joined at its ends to vertically oriented backrest side support arms which are in turn rotatably connected to a furniture member chair frame.

Most reclining chairs upholster the chair frame and support the chair frame from a stationary base assembly in a manner permitting the chair frame to "rock" freely with respect to the base assembly. In order to provide enhanced comfort and convenience, many rocking chairs also include a "reclinable" seat assembly and/or an "extensible" leg rest assembly. For example, combination platform rocking/reclining chairs, as disclosed in Applicant's U.S. Pat. Nos. 3,096,121 and 4,179,157, permit reclining movement of the seat assembly and actuation of the leg rest assembly independently of the conventional "rocking" action. The leg rest assembly is operably coupled to a drive mechanism to permit the seat occupant to selectively move the leg rest assembly between its normally retracted (i.e., stowed) and elevated (i.e., extended or protracted) positions.

Because lumbar support is substantially fixed to the back seat member, as the back seat member rotates the lumbar cushion(s) will commonly extend forwardly and upwardly. This creates a different lumbar support "feeling" for the different rotated positions of the seat back. The above lumbar support systems are not adjustable by the occupant, and therefore can result in discomfort in either the fully reclined or upright positions, or in the leg rest extended position for different occupants.

SUMMARY

According to several embodiments of the present disclosure, a lumbar support system for a furniture member includes a furniture member having a back seat member connected to an occupant support base member. A lumbar support system is connected to the furniture member. The lumbar support system includes at least one pivot tube rotatably connected to each of first and second opposed wings of the back seat member. At least one flexible occupant lumbar support member is connected to the at least one pivot tube. A lumbar support adjustment device connected to the at least one pivot tube operates to axially rotate the at least one pivot tube to selectively deflect the at least one lumbar support member to any one of a plurality of support positions.

According to additional embodiments, a lumbar support system for a furniture member includes first and second pivot tubes rotatably connected to a back seat member of the furniture member. A plurality of sinuous wire springs are connected to each of the first and second pivot tubes. A manually rotatable device is positioned between an occupant of the furniture member and an arm assembly of the furniture member. A linkage set couples the manually rotatable device to a predetermined one of the first and second pivot tubes so that rotation of the manually rotatable device operates to rotate the predetermined one of the first and second pivot tubes to displace the plurality of sinuous wire springs between any one of a plurality of occupant lumbar support positions.

According to still other embodiments, a lumbar support system for a furniture member includes first and second pivot tubes rotatably connected to a back seat member of the furniture member. A plurality of sinuous wire springs are connected to each of the first and second pivot tubes. A manually rotatable device is connected to an arm assembly of the furniture member and positioned for free rotation between an occupant of the furniture member and the arm assembly. A linkage set couples the manually rotatable device to a predetermined one of the first and second pivot tubes so that rotation of the manually rotatable device operates to rotate the predetermined one of the first and second pivot tubes to displace the plurality of sinuous wire springs between any one of a plurality of occupant lumbar support positions. A seat pan is connected to a base member of the furniture member. The base member further includes the arm assembly. The seat pan includes a flexible occupant support member positioned within an aperture of the seat pan, the occupant support member operating to deflect from a weight of the occupant.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

FIG. 16 is a top perspective view of a biasing member support clip for the occupant support assembly of FIG. 12;

FIG. 17 is a side elevational view of the biasing member support clip of FIG. 16;

DETAILED DESCRIPTION

Figure 1:
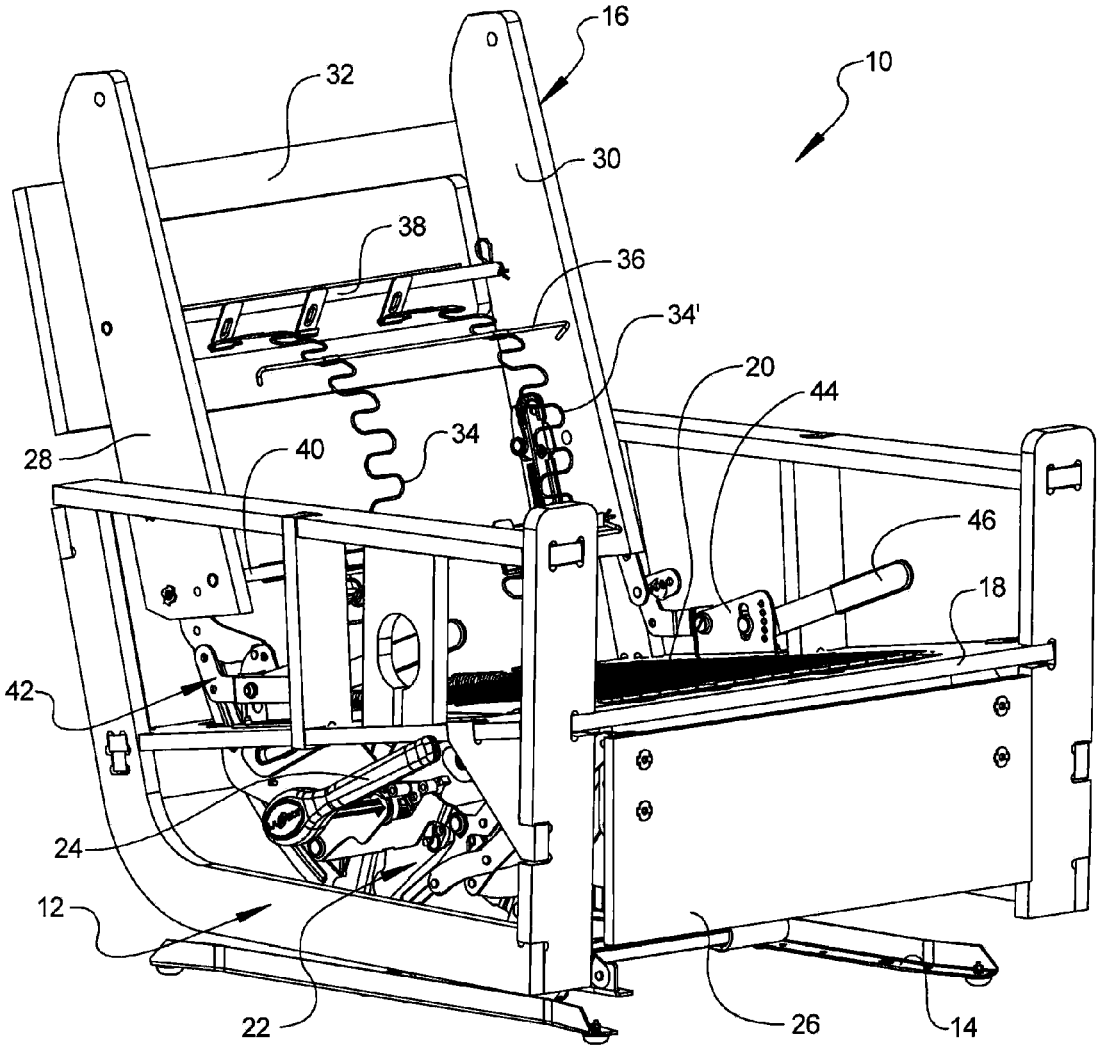
FIG. 1 is a front right perspective view of a furniture member having a lumbar support system of the present disclosure.

The following description is merely exemplary in nature and is not intended to limit the present disclosure, application, or uses. It should be understood that throughout the drawings, corresponding reference numerals indicate like or corresponding parts and features.

Referring to FIG. 1, a furniture member 10 includes a base member 12 which can be fixed, or connected for a rotating and/or a rocking motion with respect to a stationary support assembly 14. Furniture member 10 is depicted without subsequent layers of padding, cushions, or the like which are commonly known in the industry. Furniture member 10 also includes a back seat member 16, a seat pan 18 adapted to transfer the weight of an occupant of the furniture member 10 to the base member components, and an occupant support member 20 which is elastically flexible. A mechanism 22 can be provided within the base member 12 which is operated using an extension handle 24, or a latch (not shown) to extend or retract a leg rest assembly 26.

Back seat member 16 includes each of a first support wing 28, a second support wing 30, and a brace member 32 which is fixed to each of first and second support wings 28, 30 to retain first and second support wings 28, 30 substantially parallel to each other and oriented vertically when viewed from the front of the furniture member 10. At least one and in several embodiments a plurality of lumbar support members 34 are spaced from one another using at least one spacing rod 35. Opposed ends of the lumbar support members 34 can be connected to each of a first pivot tube 38 and a second pivot tube 40. First and second pivot tubes 38, 40 are cylindrical shafts. First pivot tube 38 is directly, rotatably connected at opposed ends to each of first and second support wings 28, 30. First pivot tube 38 can pivot or rotate about its own longitudinal axis.

Second pivot tube 40 is indirectly connected (using brackets to be discussed later herein) to each of first and second support wings 28, 30 and can pivot or rotate forwardly or rearwardly with respect to seat back member 16. According to several embodiments, lumbar support members 34 are sinuous wire springs made of an elastically deflectable material such as spring steel or a polymeric material and are elastically deflectable when contacted by an occupant of furniture member 10. The back seat member 16 can be fixedly coupled to the base member 12, or rotatably coupled to the base member 12 by mechanism 22 for operation between a fully upright (shown in FIG. 1) and a fully reclined position (shown in FIG. 25) without impacting the furniture member occupant desired position of the flexible occupant lumbar support members 34.

Lumbar support members 34 are adjustable using a linkage connecting member 42 connected to a bracket 44 to control a degree of support provided to the occupant. An adjustment device handle 46 is rotatably connected to bracket 44 and connected to linkage connecting member 42 which rotates one of the first or second pivot tubes 38, 40. Either an axial rotation of the first pivot tube 38, or a pivoting rotation of the second pivot tube 40 causes the lumbar support members 34 to displace in either a forward direction as viewed to the right in FIG. 1 or a rearward direction as viewed to the left in FIG. 1 to increase or decrease respectively the support provided by lumbar support members 34.

Figure 2:
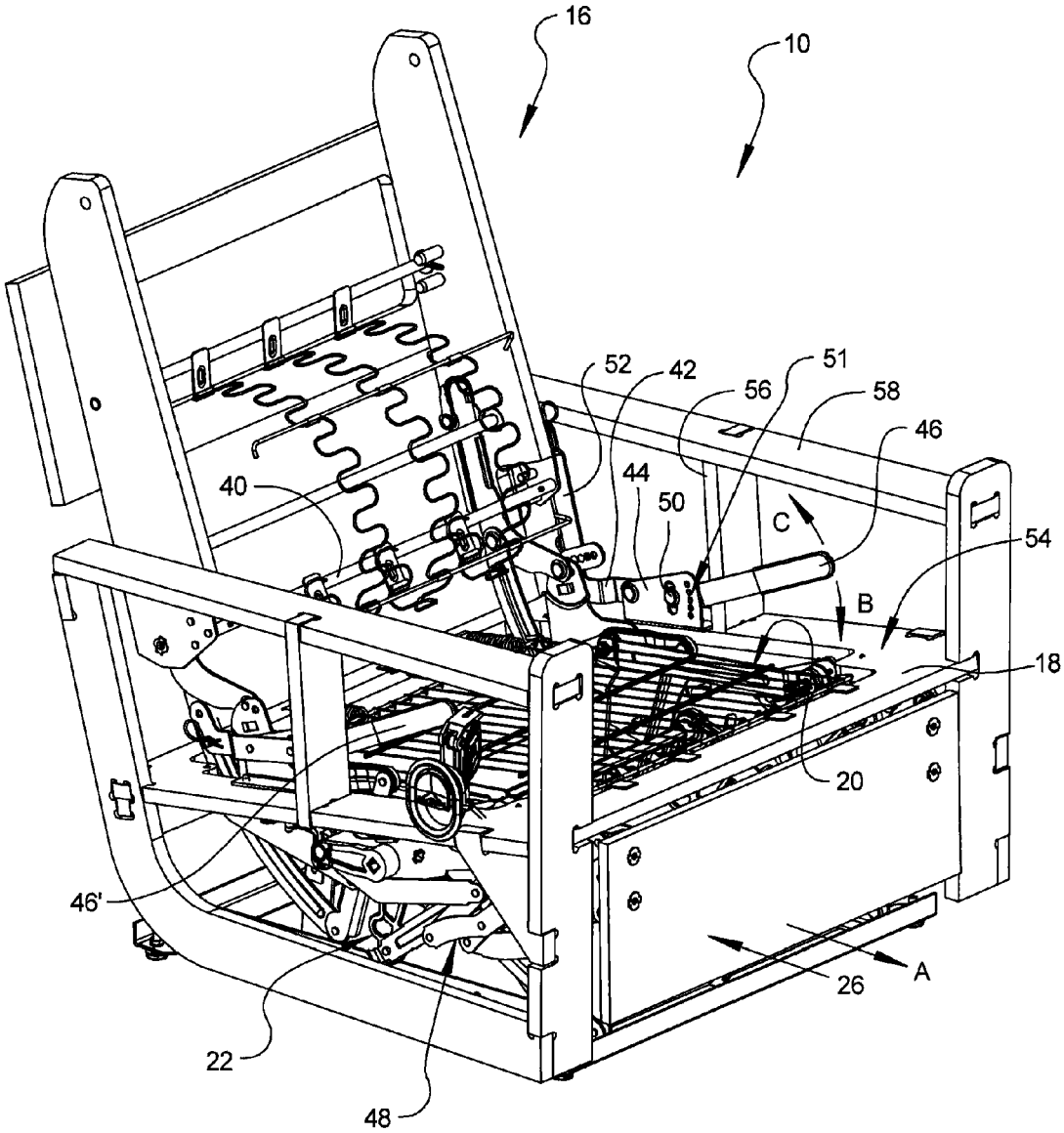
FIG. 2 is a front right perspective view similar to FIG. 1.

Referring to FIG. 2, opposed sets of pantograph linkages 48 (only a right side pantograph linkage set 48 is visible in this view) are connected to mechanism 22 and are operable to extend leg rest assembly 26 in a leg rest extension direction "A" or retract the leg rest assembly 26 in an opposite direction. A pin 50 is connected to adjustment device handle 46 and is slidably received by bracket 44. Pin 50 allows adjustment device handle 46 to be operated in either a maximum lumbar support adjustment direction "B" or a reduced lumbar support adjustment direction "C" by temporary contact of the adjustment device handle 46 with one of a plurality of detent settings 51. According to several embodiments, an actuation link 52 is rotatably connected to linkage connecting member 42. Actuation link 52 is displaced by rotation of the adjustment device handle 46.

Adjustment device handle 46 is positioned by fastenably connecting bracket 44 to a seat pan support surface 54 of seat pan 18 such that adjustment device handle 46 is positioned between an occupant (not shown) of furniture member 10 and each of an arm rest support member 56 and an arm rest member 58. The occupant seated upon occupant support member 20 can therefore actuate adjustment device handle 46 in either of the maximum lumbar support adjustment direction "B" or the reduced lumbar support adjustment direction "C" without reaching outside of either the arm rest support member 56 or the arm rest member 58. Adjustment device handle 46 can alternatively be positioned in accordance with additional embodiments as shown as adjustment device handle 46'.

Figure 3:
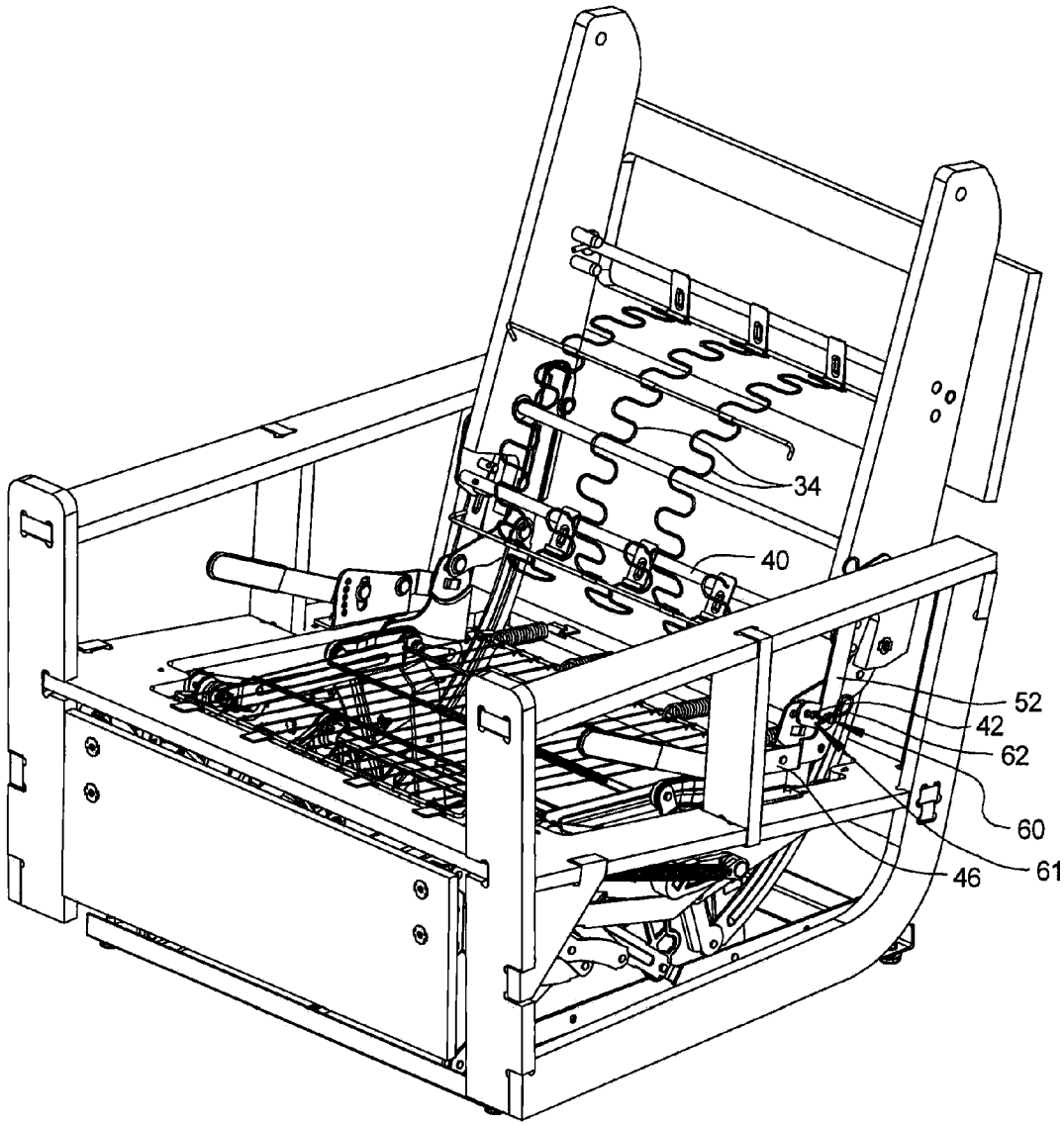
FIG. 3 is a front left perspective view of the furniture member of FIG. 1.

Referring to FIG. 3, actuation link 52 is connected to linkage connecting member 42 using a connecting pin 60 selectively engaged with one of a plurality of apertures 61 of linkage connecting member 42. Connecting pin 60 is releasably fastened using a releasable fastener 62. According to several embodiments, displacement of actuation link 52 by rotation of adjustment device handle 46 acts to rotate second pivot tube 40 to forwardly extend or rearwardly retract (with respect to a seat occupant) lumbar support members 34 to adjust the degree of support of lumbar support members 34 to the desired comfort level of the seat occupant.

Figure 4:
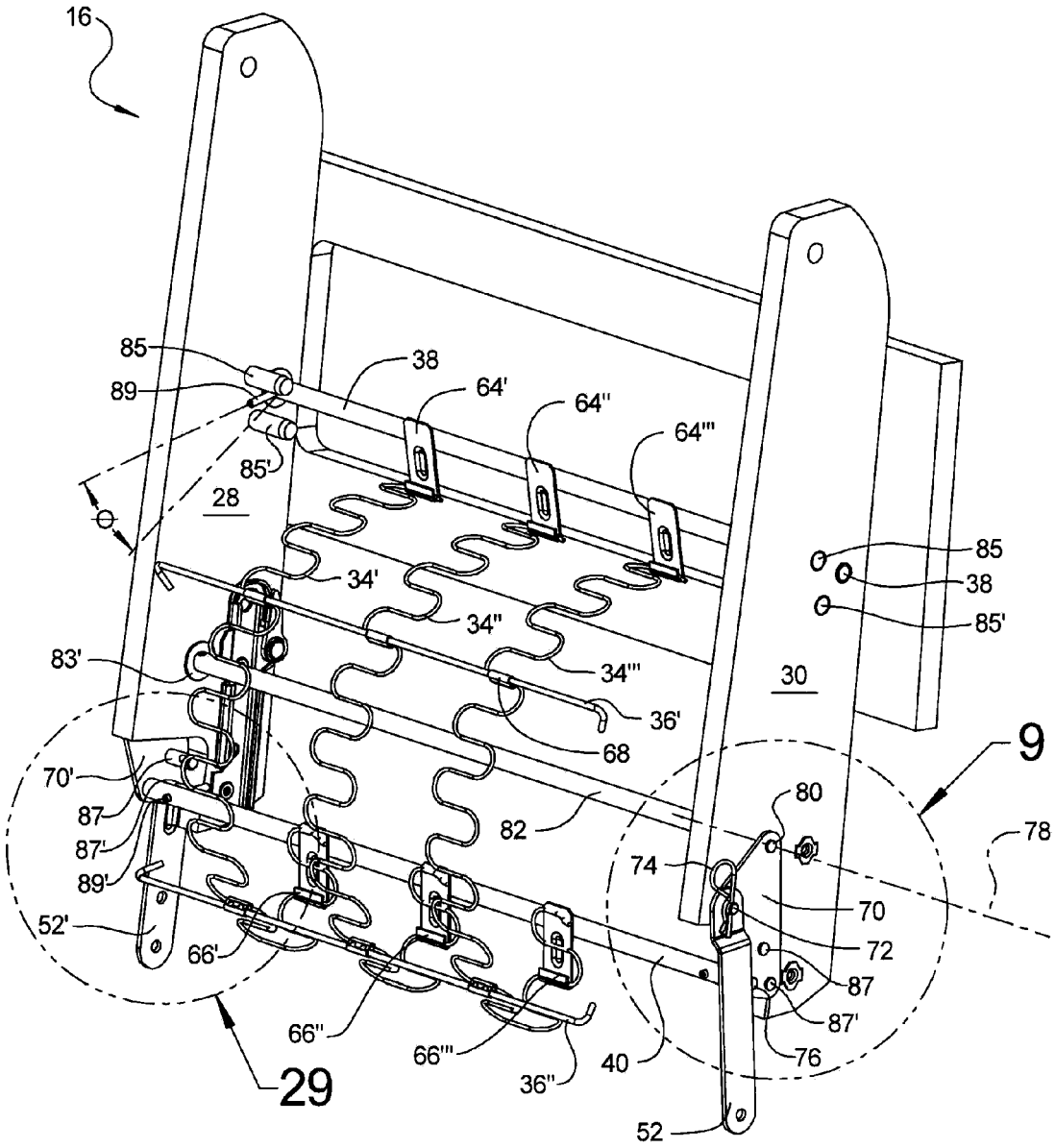
FIG. 4 is a front perspective view of the back seat member of the furniture member of FIG. 1 with a lumbar support assembly of the present disclosure.

Referring to FIG. 4, back seat member 16 is assembled as follows. Each of the lumbar support members 34, indicated as lumbar support members 34', 34", 34'" are individually connected to a plurality of first pivot tube connecting clips 64 identified as first pivot tube connecting clips 64 ', 64 ", 64 '". Opposite ends of each of the lumbar support members 34 are connected to each of a plurality of second pivot tube connecting clips 66 indicated as second pivot tube connecting clips 66', 66", 66'". It should be understood that the plurality of first and second pivot tube connecting clips 64, 66 will depend on the quantity of lumbar support members 34 that are used in the assembly. First pivot tube connecting clips 63 are fixedly attached and transversely oriented to first pivot tube 38. Similarly, second pivot tube connecting clips 66 are fixedly attached and transversely oriented to second pivot tube 40. The connection of first and second pivot tube connecting clips can be done by any method including welding, fastening, swaging, and the like provided that the first and second pivot tube connecting clips are fixed and cannot rotate with respect to first and second pivot tubes 38, 40. A plurality of connectors 68 fixedly connect each of the lumbar support members 34 to individual ones of the spacing rods 36 herein identified as spacing rods 36', 36". Connectors 68 are provided to maintain a side-to-side or clearance spacing between the lumbar support members 34 that are located proximate to each other.

A connecting end of actuation link 52 is rotatably connected to a pivot tube rotation bracket 70 defining a first connection location of bracket 70 using a connecting pin 72 and a releasable fastener 74. A fixing pin 76, 76' (only fixing pin 76 is visible in FIG. 4) inserted through pivot tube rotation bracket 70 defining a second connection location of bracket 70 is fastenably received in each of a first and second end of second pivot tube 40 to fixedly connect pivot tube rotation brackets 70, 70' to second pivot tube 40. Displacement of actuation link 52 translates a force through connecting pin 72 to pivot tube rotation bracket 70 causing pivot tube rotation bracket 70 to rotate about a pivot tube axis of rotation 78. Second fixing pins 80, 80' (only fixing pin 80 is visible in FIG. 4) are used to fastenably connect pivot tube rotation brackets 70, 70' defining a third connection location of brackets 70, 70' to opposed ends of a third pivot tube 82. Third pivot tube 82 is horizontally oriented and is also rotatably connected at opposite ends to the opposed arms or first and second support wings 28, 30 of the back seat member 16. Pivot tube axis of rotation 78 is therefore created through a center of each of second fixing pins 80, 80' and third pivot tube 82.

Rotation of pivot tube rotation brackets 70, 70' about pivot tube axis of rotation 78 causes second pivot tube 40 to pivot or rotate either forwardly or rearwardly from the position shown which allows the position of each of the lumbar support members 34 to be adjusted to the comfort level of the occupant of the furniture member. For example, rotation of second pivot tube 40 toward the viewer as shown in FIG. 4 displaces each of the lumbar support members 34 forwardly thereby increasing the amount of lumbar support. As evident, an opposite rotation of second pivot tube 40 about pivot tube axis of rotation 78 away from the viewer as shown in FIG. 4 decreases the amount of lumbar support provided by lumbar support members 34 by moving lumbar support members 34 away from an occupant of the furniture member and to the rear of the furniture member. According to additional embodiments, actuation link 52 and pivot tube rotation bracket 70 can either be relocated or can be made redundant by use of actuation link 52' connected to rotate pivot tube rotation bracket 70' as shown.

Each of first pivot tube 38 and third pivot tube 82 are connected at opposing ends to first and second support wings 28, 30 of back seat member 16. Second pivot tube 40 is connected at opposite ends to each of pivot tube rotation bracket 70 and pivot rube rotation bracket 70'. Contact members such as washers 83, 83' are positioned at opposite ends of both first pivot tube 38 and third pivot tube 82 to allow limited rotation of first pivot tube 38 and third pivot tube 82 with respect to first and second support wings 28, 30, and also to maintain a spacing between first and second support wings 28, 30. The third pivot tube defines axis of rotation 78 of first and second pivot tube rotation brackets 70, 70' and the predetermined rotating one of the pivot tubes, second pivot tube 40.

Each of first and second pivot tubes 38, 40 can also rotate about their respective longitudinal axes, in addition to the rotation described above by rotation of actuation link 52. This axial rotation occurs as a synchronous rotation when either the first or second pivot tube 38, 40 is displaced, when back support 16 is rotated to the fully reclined position, and/or if the weight of the furniture member occupant displaces lumbar support members 34', 34", 34'"rearwardly (to the right as viewed in FIG. 4) in an upright position of back support member 16. Therefore, to provide a limit on the amount of axial rotation of first or second pivot tube 38, 40 to prevent collapse of the lumbar support members 34', 34", 34'"into the structure of back support member 16, first and second contact pins 85, 85' are fastened to both first and second support wings 28, 30, and third and fourth contact pins 87, 87' are fastened to each of pivot tube rotation brackets 70, 70'.

A fastener 89 such as a metal roll pin is frictionally inserted into an aperture of each of the opposed ends of first pivot tube 38. Similarly, fastener 89' such as a metal roll pin is frictionally inserted into an aperture of each of the opposed ends of second pivot tube 40. Fasteners 89, 89' extend freely from both ends of first and second pivot tubes 38, 40 so they can contact first, second, third, and fourth contact pins 85, 85', 87, 87' respectively. Only fasteners 89, 89' inserted through the left ends of first and second pivot tubes 38, 40 are visible in FIG. 4. First, second, third, and fourth contact pins 85, 85', 87, 87' are therefore positioned at each of the first and second opposed wings 28, 30 and are oriented substantially parallel to the first and second pivot tubes 38, 40.

Fasteners 89 are normally positioned in contact with first contact pins 85, and as first pivot tube 38 axially rotates are synchronously co-rotated with first pivot tube 38 until fasteners 89 contact second contact pins 85'. First and second contact pins 85, 85' are selectively spaced from each other to permit fasteners 89 to rotate within an angular range defined by an angle θ, which according to several embodiments is approximately 20-25 degrees. Angle θ can vary higher or lower than this range as the size or constraints of furniture member 10 vary.

Fasteners 89' and third and fourth contact pins 87, 87' are similarly arranged with respect to fasteners 89 and second contact pins 85, 85'. Fasteners 89' together with second pivot tube 40 can therefore rotate through a similar angle θ. Fasteners 89', however, are normally positioned in contact with fourth contact pins 87', and therefore rotate upwardly as viewed in FIG. 4 to contact third contact pins 87 to define a maximum rotation of second pivot tube 40.

Figure 5:
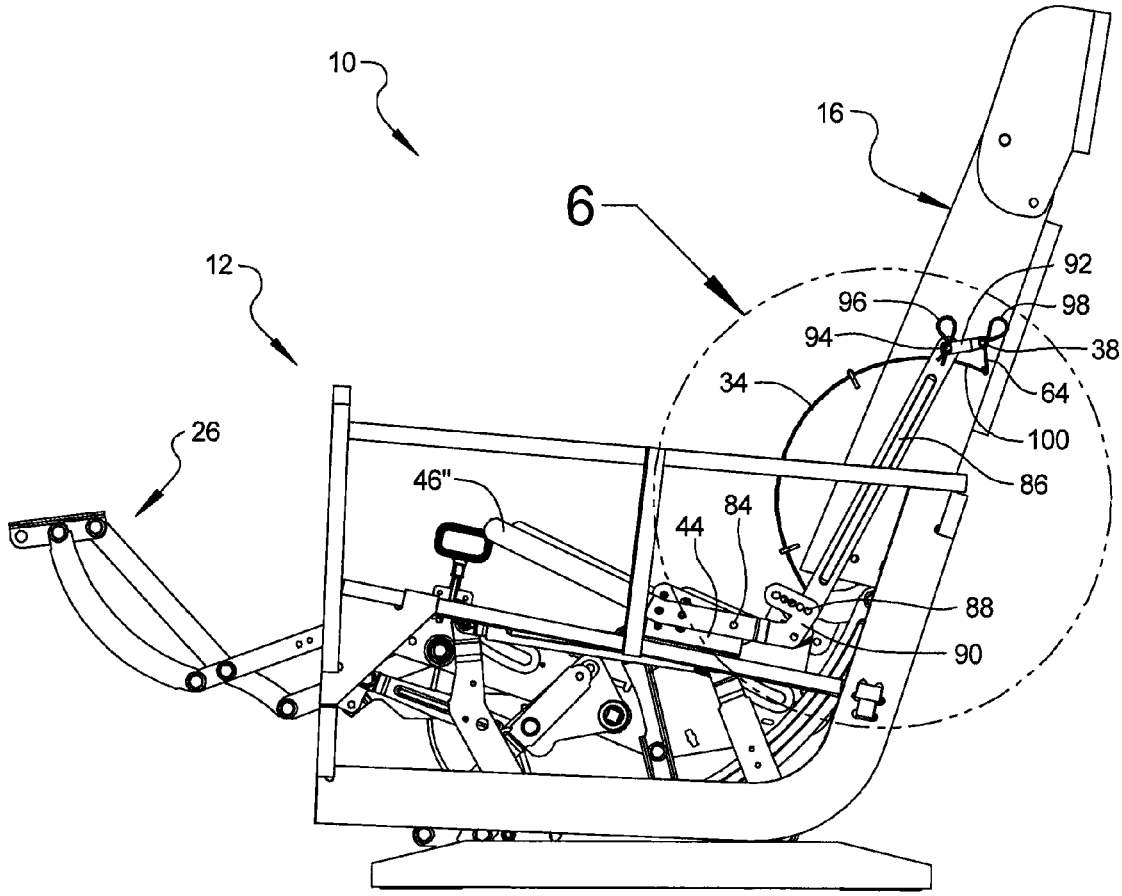
FIG. 5 is a left side elevational view of another embodiment of the furniture member of FIG. 1 showing an extended leg rest assembly and a neutrally positioned lumbar adjustment device.

Referring to FIG. 5, furniture member 10 is shown with back seat member 16 in a fully upright position and leg rest assembly 26 in a fully extended position. A further embodiment of a lumbar adjustment system of the present disclosure is shown in FIG. 5 having an adjustment device handle 46" connected to bracket 44 using a handle connecting pin 84. A second actuation link 86 is used in place of actuation link 52 shown in the previous Figures which is operable to rotate first pivot tube 38. Second actuation link 86 is connected using a link connecting pin 88 to a link connecting end 90 of adjustment device handle 46". Rotation of adjustment device handle 46" about handle connecting pin 84 is therefore operable to displace second actuation link 86 for control of the lumbar support members 34. Second actuation link 86 is connected to a pivot link 92 using a pivot pin 94 and a releasable fastener 96. Pivot link 92 is in turn connected to first pivot tube 38 using a releasable fastener 98. A first member end 100 of each of the plurality of lumbar support members 34 are connected to the individual first pivot tube connecting clips 64. A "neutral" position of adjustment device handle 46" is shown. The neutral position is unaffected by subsequent rotation of back seat member 16 with respect to base member 12. The neutral position of adjustment device handle 46" and therefore the neutral position of each of the lumbar support members 34 is also unaffected by the extension or full retraction of leg rest assembly 26.

Figure 6:
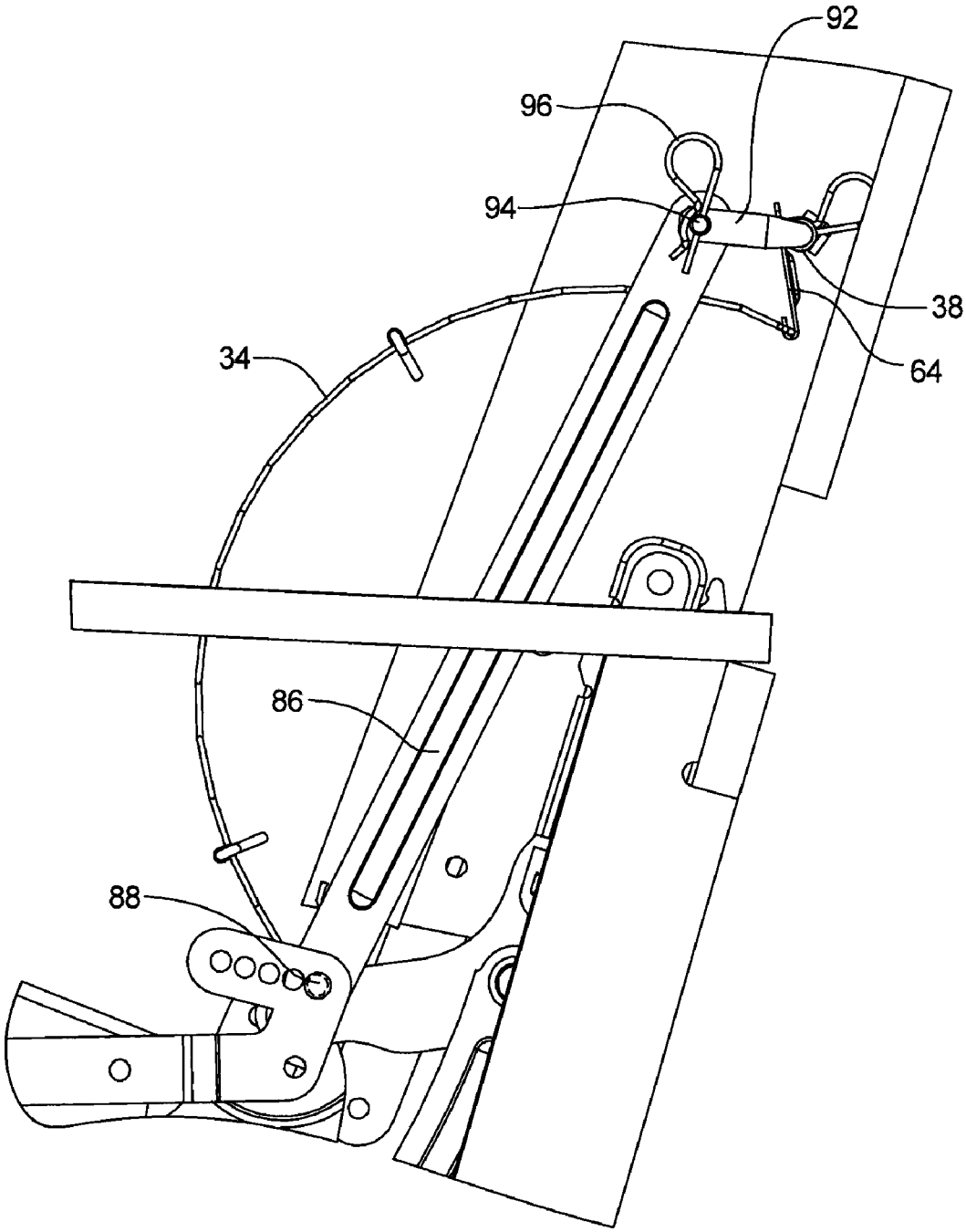
FIG. 6 is an elevational view of area 6 of FIG. 5 having the lumbar adjustment device neutrally positioned.

Referring to FIG. 6, in the neutral position, the lumbar support members 34 define a forwardly oriented arch (forward referring to a direction to the left of the viewer as viewed in FIG. 6). Upward or downward translation of second actuation link 86 from the position shown will rotate each of the first pivot tube connecting clips 64 and therefore alter the displacement or arc of the lumbar support members 34. Because of the rigid construction of pivot link 92 and second actuation link 86, elastic deformation of lumbar support members 34 when contacted by an occupant of the furniture member can occur without forced rotation of first pivot tube 38. A linkage set for this embodiment includes actuation link 86 rotatably connected to the handle 46" and pivot link 92 non-rotatably connected to the predetermined rotating one of the pivot tubes, first pivot tube 38, and rotatably connected to the actuation link 86.

Figure 7:
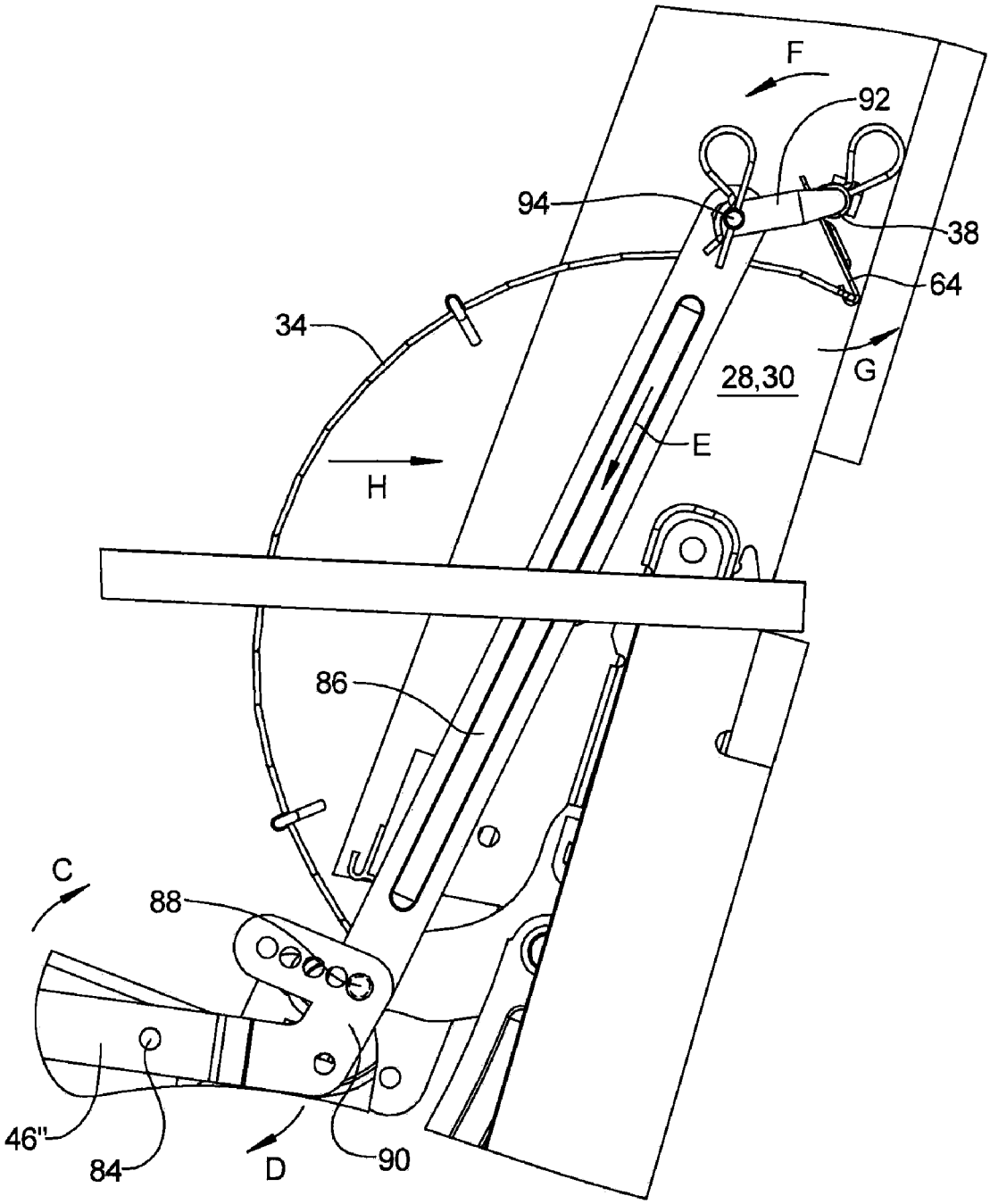
FIG. 7 is a side elevational view of area 6 of FIG. 5 modified to show the lumbar adjustment device positioned for reduced support.

Referring to FIG. 7, by manually rotating adjustment device handle 46" in the reduced lumbar support adjustment direction "C" about handle connecting pin 84, link connecting end 90 is rotated in a connecting end displacement direction "D" which concomitantly displaces second actuation link 86 in a first link displacement direction "E". This displacement in turn causes rotation of pivot link 92 and therefore rotation of first pivot tube 38 in a first pivot tube rotation direction "F". This causes each of the first pivot tube connecting clips 64 to rotate in a first clip rotation direction "G" thereby displacing the lumbar support members 34 in a lumbar support reduction direction "H". Adjustment device handle 46" can be retained in a plurality of the detent settings 51 to control an ever decreasing amount of lumbar support member occupant support force.

Figure 8:
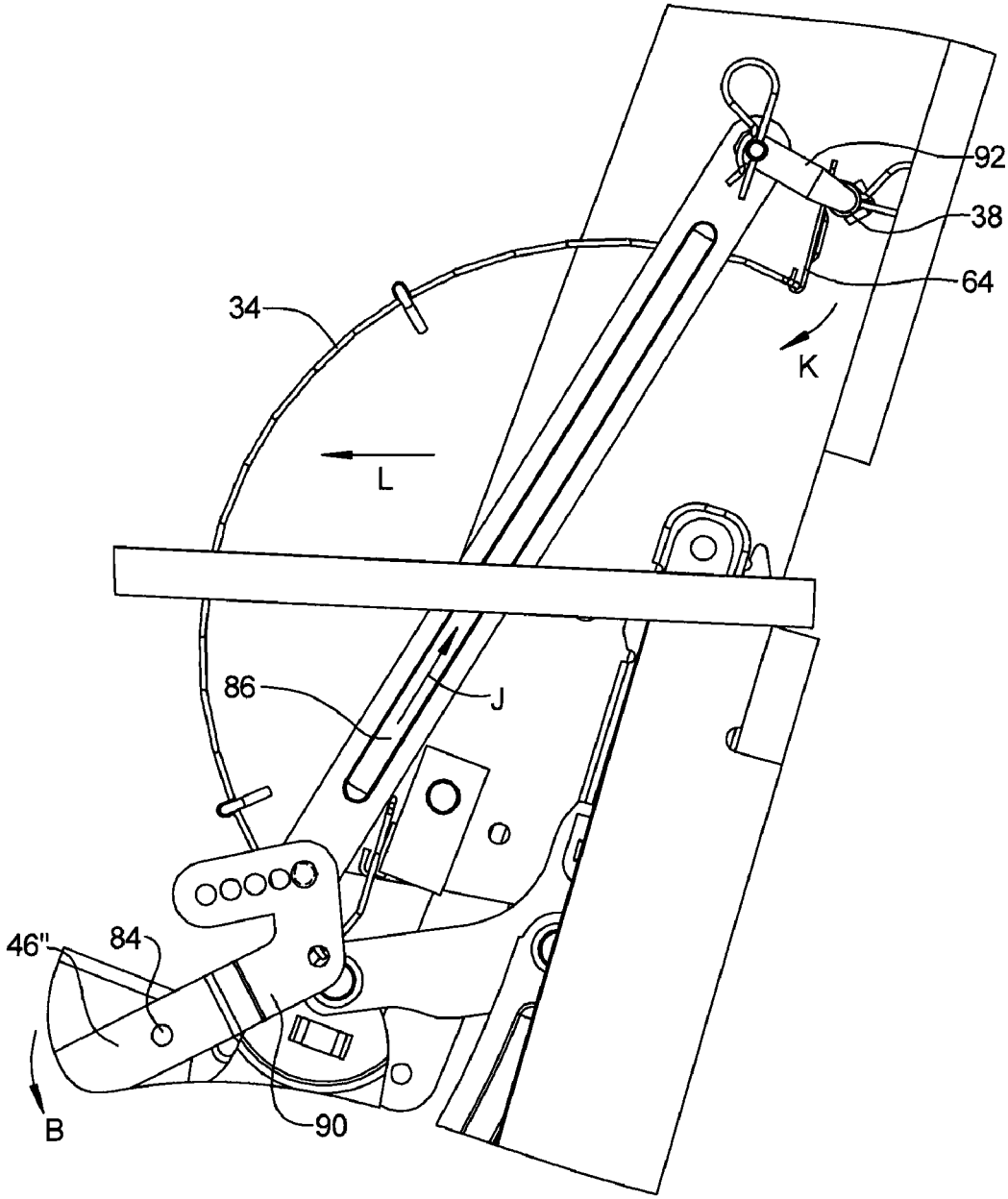
FIG. 8 is a side elevational view modified from FIG. 7 to show the lumbar adjustment device positioned for maximum support.

Referring to FIG. 8, an opposite rotation of adjustment device handle 46" compared to that shown in FIG. 7 in the maximum lumbar support adjustment direction "B" about handle connecting pin 84 displaces link connecting end 90 and therefore displaces second actuation link 86 in a second link displacement direction "J". This displacement causes an opposite rotation of first pivot tube 38 which therefore rotates each of the first pivot tube connecting clips 64 in a second clip rotation direction "K" displacing each of the lumbar support members 34 in a lumbar support maximizing direction "L". Lumbar support maximizing direction "L" acts toward an occupant of the furniture member and therefore increases the lumbar support provided by lumbar support members 34.

Figure 9:
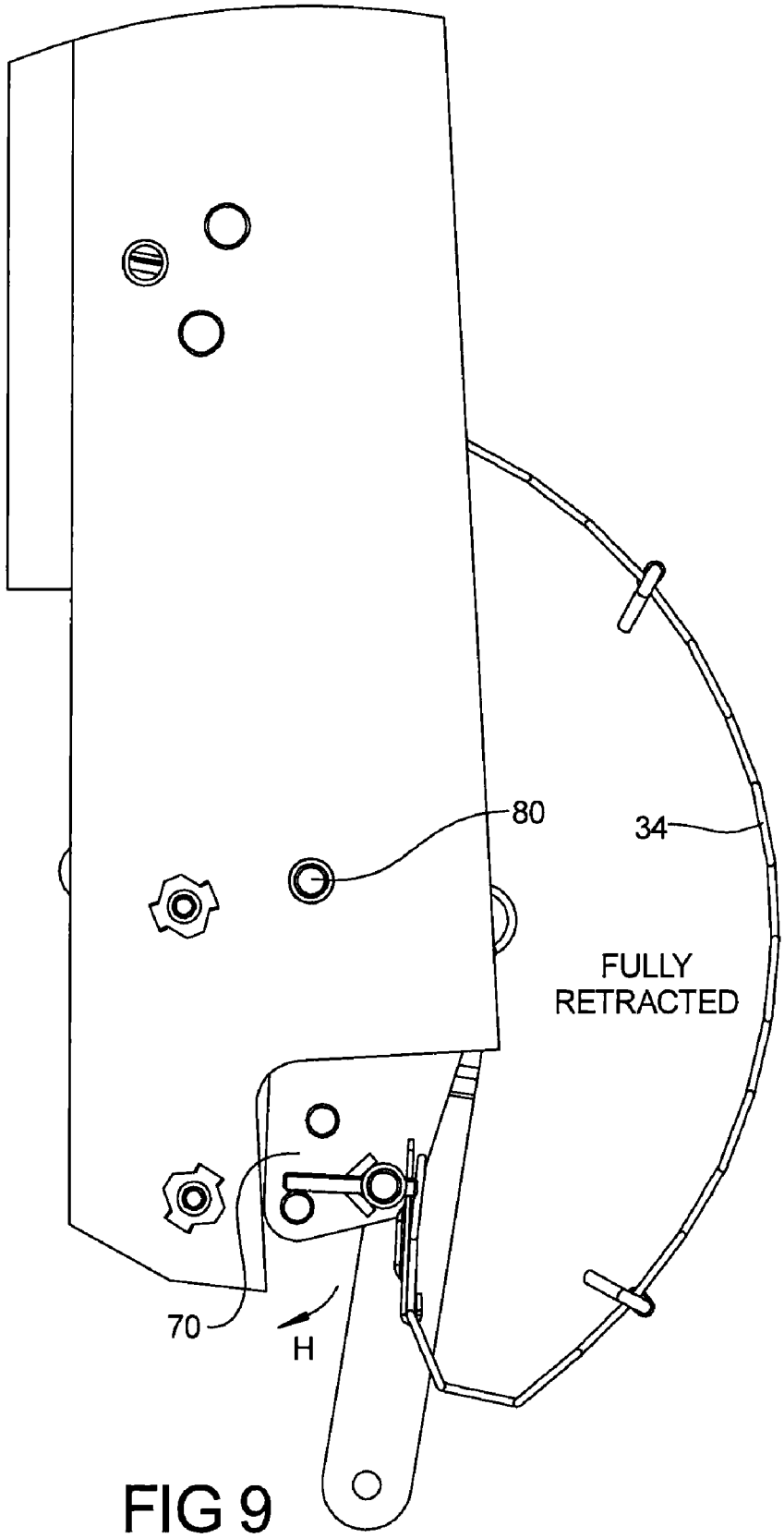
FIG. 9 is a side elevational view of area 9 of FIG. 4 modified to show the lumbar adjustment device positioned for reduced support.
Figure 10:
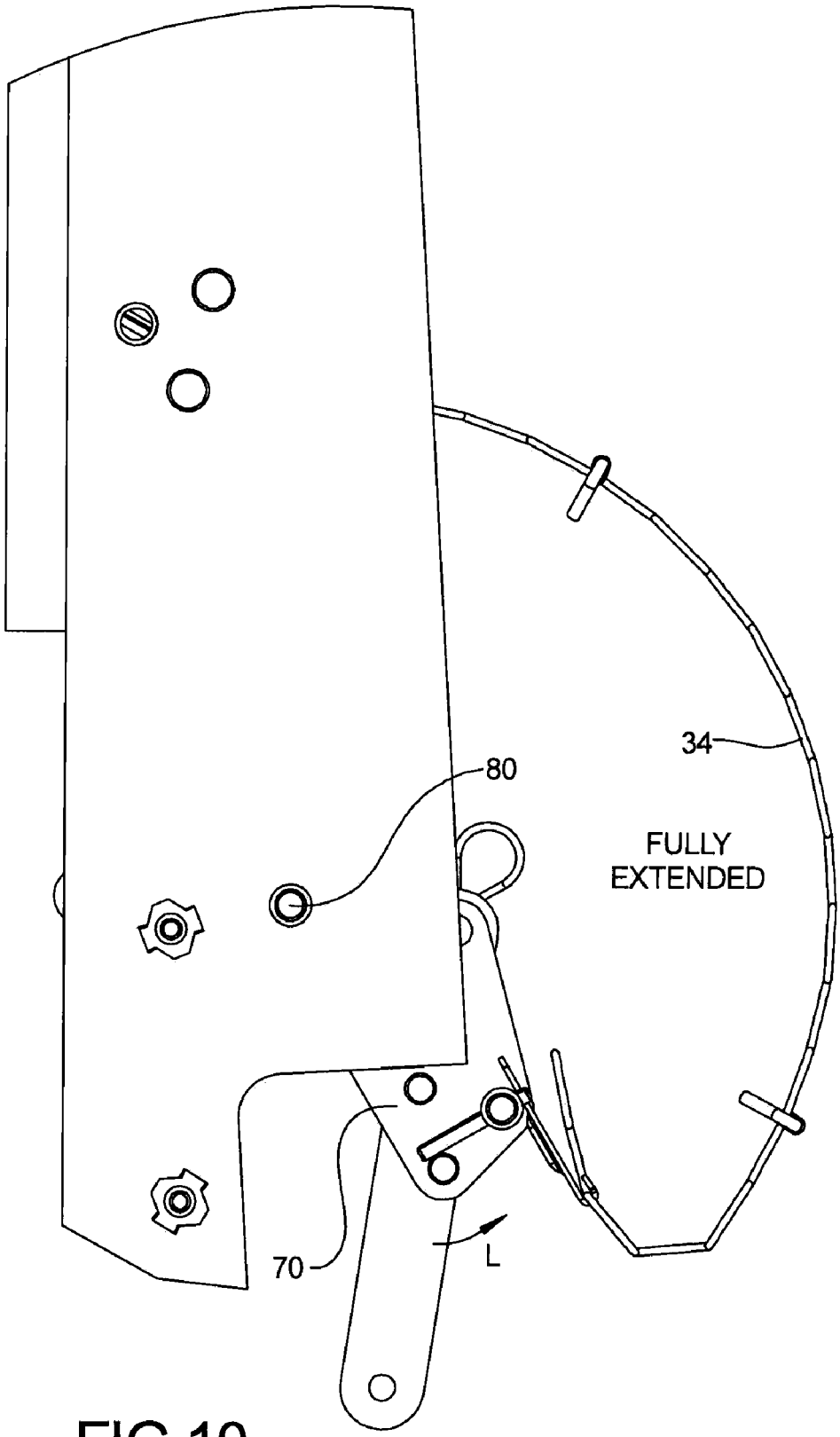
FIG. 10 is an elevational view modified from FIG. 9 to show the lumbar adjustment device positioned for maximum support.

Referring now to FIGS. 9 and 10, according to the embodiment of the lumbar adjustment system shown in FIG. 4, a fully retracted or reduced lumbar support for lumbar support members 34 is provided by rotating pivot tube rotation bracket 70 in the lumbar support reduction direction "H" as shown in FIG. 9. A fully extended or maximum lumbar support can be provided by rotating pivot tube rotation bracket 70 in the lumbar support maximizing direction "L" as shown in FIG. 10. As previously noted, pivot tube rotation bracket 70 rotates with respect to second fixing pin 80.

Figure 11:
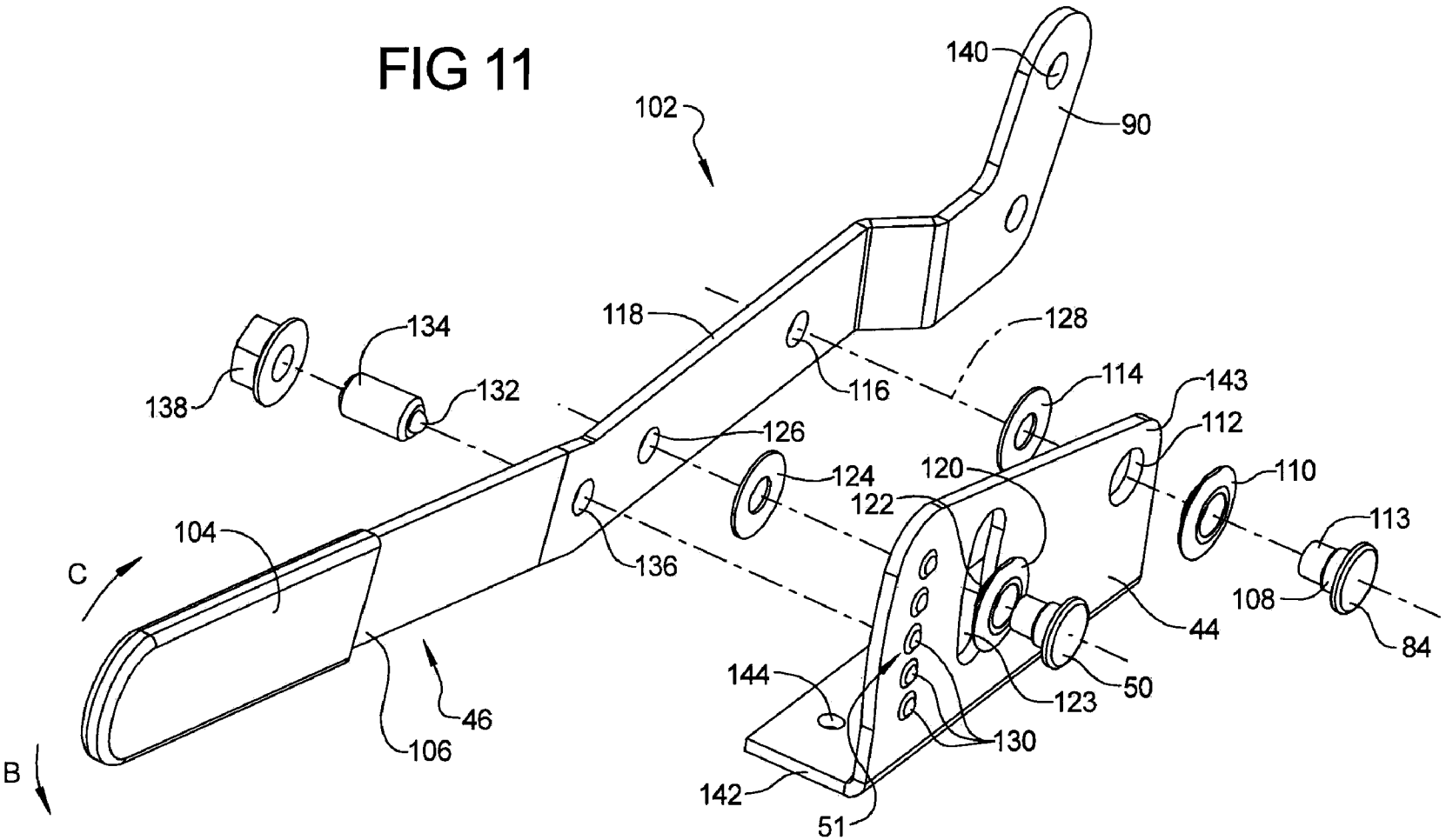
FIG. 11 is an exploded assembly view of a lumbar support adjustment device of the present disclosure.

Referring to FIG. 11, according to several embodiments, a handle assembly defining a lumbar support adjustment device 102 includes adjustment device handle 46 rotatably connected to bracket 44. A handle grip 104 of a polymeric or rubber compound can be connected to adjustment device handle 46 at a handle grip end 106. Adjustment device handle 46 is rotatably connected to bracket 44 using handle connecting pin 84 which includes a first body shaft 108 which is rotatably received within a first spin washer 110. According to several embodiments, handle connecting pin 84 is a metal spin rivet. First spin washer 110 is in turn received within an aperture 112 formed in bracket 44. A second body shaft 113 having a smaller diameter than first body shaft 108 extends beyond bracket 44 and is received within a spacer washer 114 disposed between bracket 44 and adjustment device handle 46. Second body shaft 113 is rotatably received within an aperture 116 created in a handle body 118 of adjustment device handle 46. Second body shaft 113 can then be upset or peened to rotatably couple adjustment device handle 46 to bracket 44 of adjustment device handle assembly 102.

Pin 50 is similar to handle connecting pin 84 and is received within a second spin washer 120 which includes a washer shaft 122 slidably disposed within an elongated arcuate aperture 123 created in bracket 44. Pin 50 then extends through a spacer washer 124 and is received within an aperture 126 of handle body 118. Pin 50 is then upset or peened similar to handle connecting pin 84 to prevent removable of pin 50. Adjustment device handle 46 is thereafter operable to rotate about a handle axis of rotation 128 centrally defined through handle connecting pin 84. Pin 50 is retained within elongated arcuate aperture 123 which defines the upper and lower limits of rotation for adjustment device handle 46. Pin or spin rivet 84 rotatably connects the adjustment device handle 46 to the bracket 44 and is positioned between the handle grip end 106 and the link connecting end 90 to permit a pivoting motion of the handle 46.

A plurality of through apertures or detent dimples 130 are created in bracket 44 which releasably receive an biased displaceable ball 132 which extends outwardly from a cylinder 134. Cylinder 134 is in turn received within an aperture 136 of handle body 118. A fastener or nut 138 is used to fix cylinder 134 in position with respect to handle body 118. Displaceable ball 132 is biased to an outward position shown and displaceable into and out of cylinder 134 using a biasing element (not shown) such as a spring positioned within cylinder 134 which acts to elastically bias displaceable ball 132. Displaceable ball 132 engages with individual ones of the plurality of detent dimples 130 as adjustment device handle 46 is rotated within the constraints defined by elongated arcuate aperture 123. Each of the plurality of detent features or detent dimples 130 equate to individual ones of the plurality of support positions (which include but are not limited to the maximum lumbar support position, the neutral lumbar support position, and the reduced or minimum lumbar support position). Fewer or greater numbers of detent dimples 130 can also be used (five are shown) within the scope of the present disclosure. The maximum lumbar support position is defined as the lowest detent dimple viewed in FIG. 11. The reduced or minimum lumbar support position is defined as the highest detent dimple viewed in FIG. 11. The neutral lumbar support position is defined as the central detent dimple viewed in FIG. 11.

Bracket 44 is fastenably connected to seat pan support surface 54 of seat pan 18 as described in reference to FIG. 2 using a plurality of apertures (not shown) inserted through a plurality of fastener receiving apertures 144 created in a flange 142 of bracket 44. Aperture 112, elongated arcuate aperture 123, and each of the plurality of detent dimples 130 are created in a second flange 143 which according to several embodiments is oriented transverse to flange 142. A pin receiving aperture 140 is also provided in link connecting end 90 to receive connecting pin 60 shown and described in reference to FIG. 3.

Figure 12:
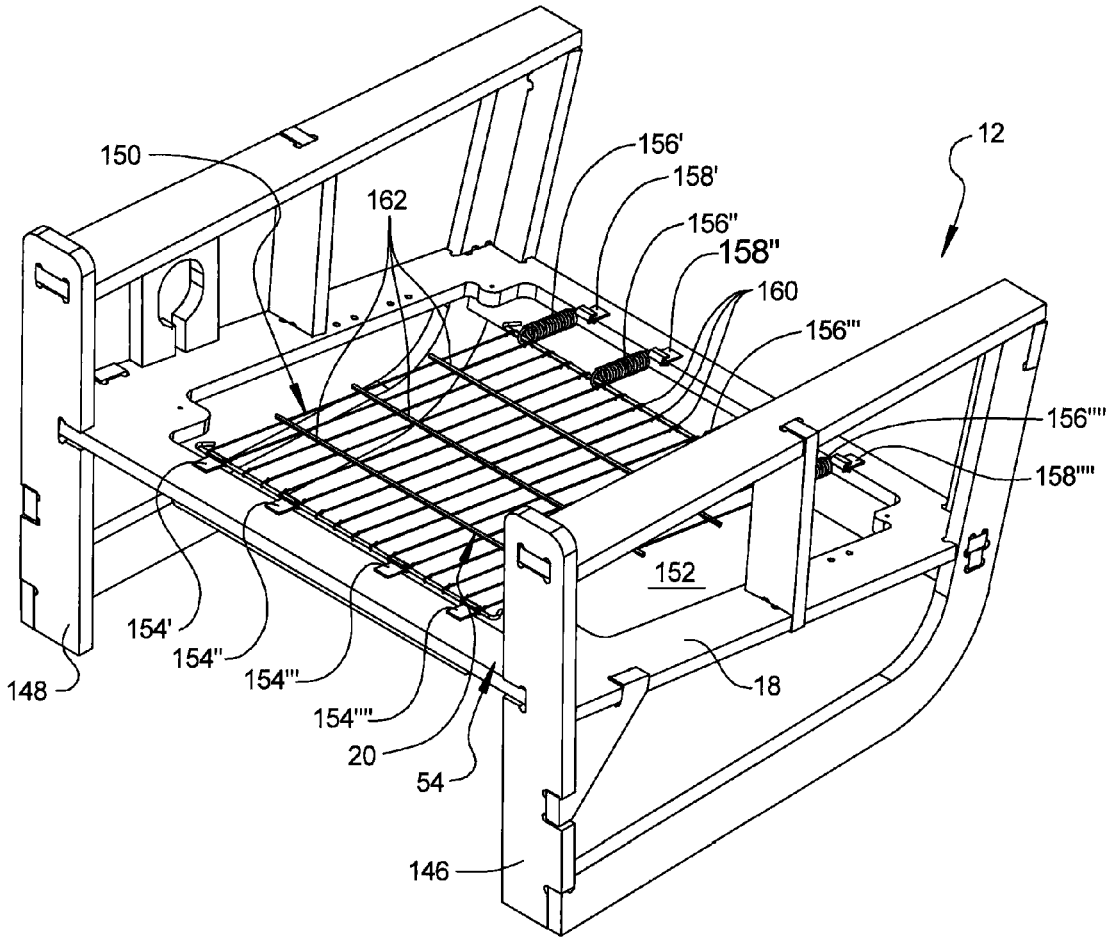
FIG. 12 is a front left perspective view of the seat base having a first embodiment of an occupant support assembly of the present disclosure.

Referring to FIG. 12, base member 12 can include each of a first and second arm rest member 146, 148. Seat pan 18 is fixedly connected to each of first and second arm rest members 146, 148. An occupant support surface 150 is defined by an upwardly facing side of occupant support member 20. A displacement aperture 152 is created in seat pan 18 to allow for vertical deflection of occupant support member 20 while limiting a total downward displacement to prevent contact of occupant support member 20 with mechanism 22 shown and described in reference to FIG. 1. A plurality of first attachment clips 154 shown as first attachment clips 154', 154", 154''', 154''' are connected to seat pan support surface 54. A first or forward end of occupant support member 20 is engaged with each of the first attachment clips 154. A plurality of biasing elements, in several embodiments defined as coiled tension springs 156, shown as biasing elements 156', 156", 156''', 156''' are connected a rear or right end as shown in FIG. 12 of occupant support member 20. Each of the biasing elements 156 are in turn connected to a plurality of second attachment clips 58 which are also fixed to seat pan support surface 54. First and second attachment clips 154, 158 are substantially identical to each other. Biasing elements 156 are provided to allow the downward displacement of the rear portion of occupant support member 20 from the weight of the occupant of furniture member 10. Limited elastic deflection of occupant support member 20 is also provided by using a plurality of wire elements 160 which are transversely fixed to a plurality of support wires 162. The occupant support member 20 at least partially spans aperture 152 of the seat pan 18, wherein deflection of the occupant support member 20 occurs without interference with the lumbar support adjustment device 102.

Figure 15:
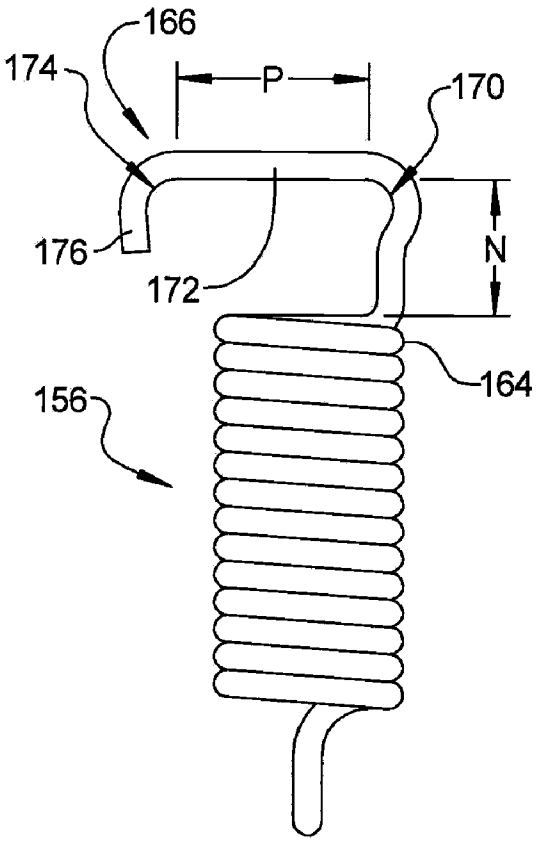
FIG. 15 is a front elevational view of the biasing member of FIG. 13.
Figure 14:
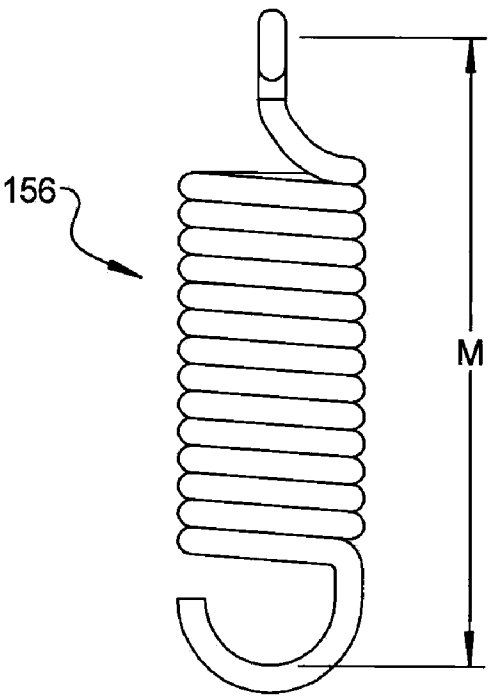
FIG. 14 is a side elevational view of the biasing member of FIG. 13.
Figure 13:
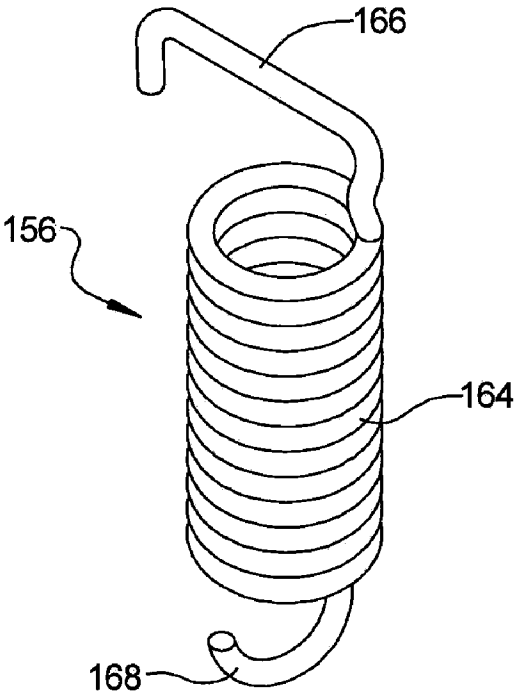
FIG. 13 is a front perspective view of a biasing member for the occupant support assembly of FIG. 12.

Referring to FIGS. 13-15, each of the biasing elements 156 includes a coiled body 164, a clip engagement end 166, and a support member engagement end 168. When no load is placed on the biasing elements 156 each of the biasing elements 156 have a non-extended length "M". Clip engagement end 166 is created by forming a first bend 170, a substantially straight portion defining a clip contact leg 172, a second bend 174, and a retention leg 176. Retention leg 176 is angled or directed back toward body 164 to help prevent loss of contact between each of the plurality of second attachment clips 158 shown in reference to FIG. 12 and clip contact legs 172 of the biasing elements 156. A clip clearance dimension "N" is provided to allow engagement of clip engagement end 166. Clip contact leg 172 has a clip contact length "P" which is equal to or greater than a width of second attachment clips 158.

Referring to FIGS. 16 and 17, each of the first and second attachment clips 154, 158 include a clip body 178 which is substantially flat or planar, having a clip retention leg 180 extending transversely from clip body 178. Clip retention legs 180 are received within slots (not shown) created in the seat pan support surface 54 of seat pan 18 (shown in FIG. 12). A hooked or rounded end 182 is provided proximate to the clip retention legs 180. A barb 184 is created at a free end of the hooked ends 182. One purpose for barb 184 is to help retain the clip contact leg 172 of the biasing elements 156. Hooked end 182 defines an angle $\alpha$ with respect to clip body 178. According to several embodiments, angle $\alpha$ can range from approximately five degrees to twenty-five degrees. Barb 184 defines an angle $\beta$ with respect to hooked end 182. According to several embodiments, angle $\beta$ can range from approximately ten to thirty degrees. The ranges of angles $\alpha$ and $\beta$ provided herein are not limiting and can be modified at the discretion of the manufacturer.

Figure 18:
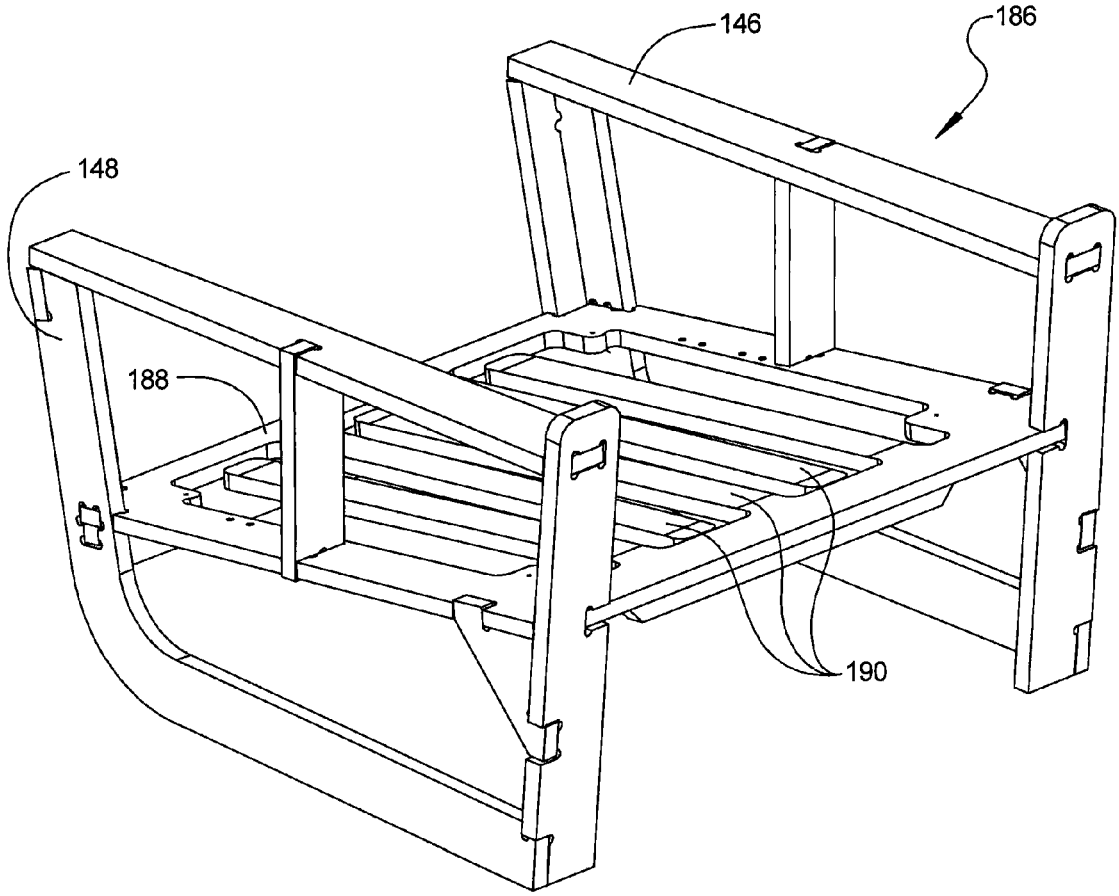
FIG. 18 is a front right perspective view of the seat base having a second embodiment of an occupant support assembly of the present disclosure.

Referring to FIG. 18, according to additional embodiments of the present disclosure, a base member 186 is modified from base member 12 to replace seat pan 18 with a deflectable member seat pan 188. Deflectable member seat pan 188 provides a plurality of oppositely facing or oppositely directed deflectable members 190. According to several embodiments, deflectable member seat pan 188 can be provided from a wood material such as plywood, or a polymeric or composite material such that deflectable members 190 can elastically deflect from the substantially flat or planar position shown in FIG. 18 due to the weight of an occupant.

Figure 19:
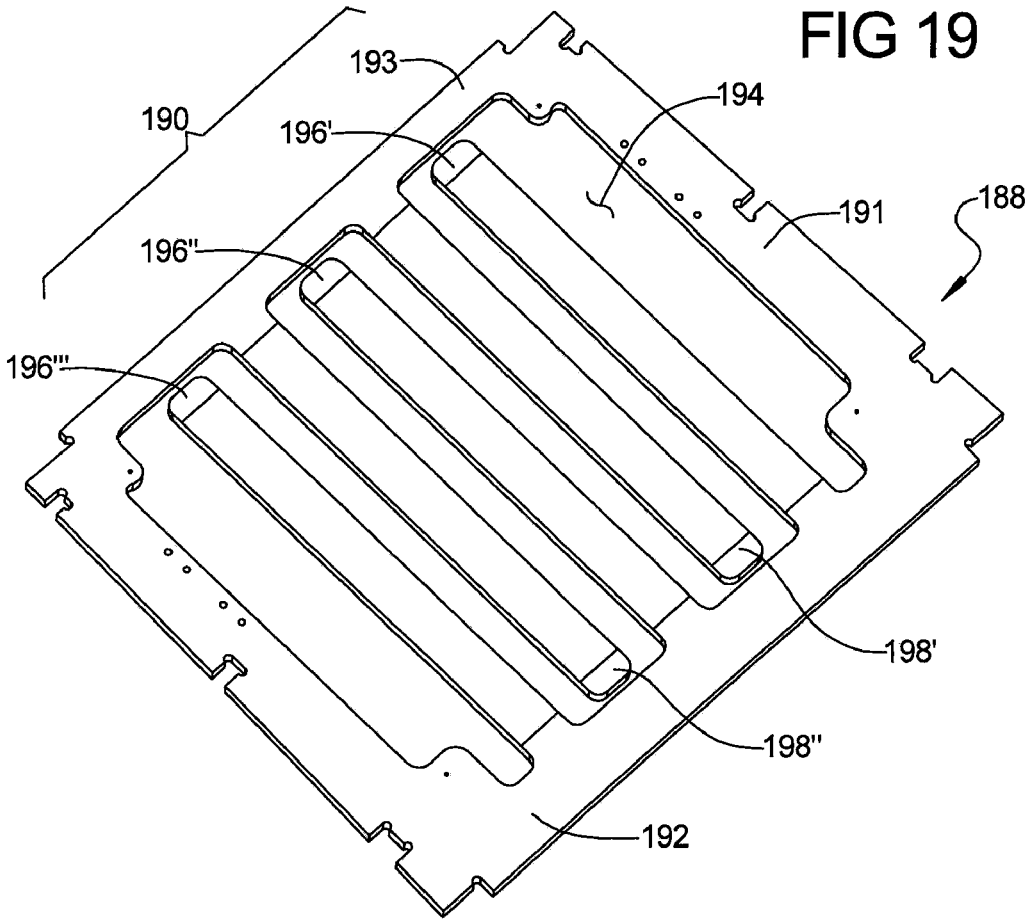
FIG. 19 is a top plan view of the occupant support assembly of FIG. 18.
Figure 20:
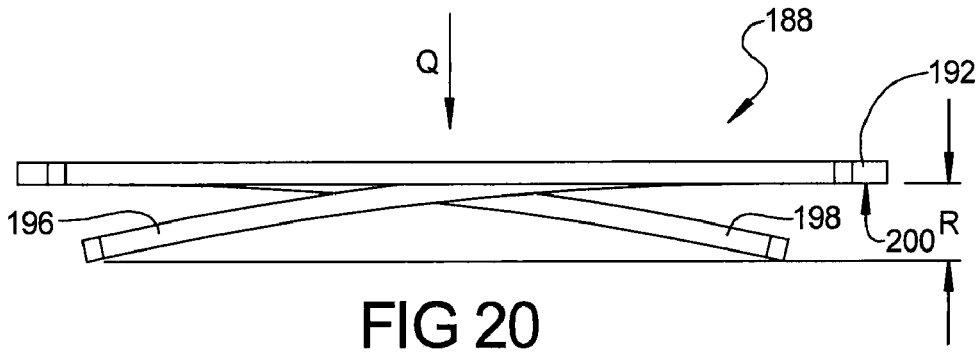
FIG. 20 is a side elevational view of the occupant support assembly of FIG. 18.

Referring to FIGS. 19 and 20, deflectable member seat pan 188 includes a pan frame 191 having a first frame end 192 and a second frame end 193 which is oriented opposite to and substantially parallel with first frame end 192. A displacement aperture 194 is created in pan frame 191 to permit deflection of each of the deflectable members 190. Deflectable members 190 include each of a plurality of first displaceable members 196', 196", 196''' defining a first displacement member set 196 and a plurality of second displacement members 198', 198" defining a second displacement member set 198. Each of the displaceable members of first displaceable member set 196 are homogenously connected to and extend from first frame end 192. Each of the displaceable members of second displaceable member set 198 are homogenously connected to and extend from second frame end 193. Each of the displaceable members of first displaceable member set 196 shown as displaceable members 196', 196", 196''' have a free end proximate to second frame end 193 and are oriented substantially parallel with each of the displaceable members of second displaceable member set 198. The displaceable members of second displaceable member set 198 identified as displaceable members 198', 198", have a free end positioned proximate to first frame end 192. Displaceable members 198' and 198" are positioned between proximate ones of displaceable members 196', 196", 196'".

As best shown in reference to FIG. 20, each of the free ends of the displaceable members of first and second displaceable member sets 196, 198 can elastically deflect with respect to a surface 200 in a displacement direction "Q" to a maximum displacement depth "R". According to several embodiments, displacement depth "R" can be approximately 2.0 in (3.1 cm). The displaceable members then elastically deflect back to the original or substantially planar position shown in FIG. 19 when the occupant load is removed from the deflectable member seat pan 188. Individual ones of the second plurality or second displaceable member set 198 are therefore interspersed between proximate ones of the first plurality or first displaceable member set 196 of flexible fingers. The second plurality of flexible fingers of second displaceable member set 198 extend in a second direction opposite to the first direction of the first displaceable member set 196 and partially across the aperture 194 of the seat pan 188. Elastic deflection of the first and second plurality of fingers of first and second displaceable member sets 196, 198 from the weight of the occupant occurs without interference of any of the flexible fingers with the manually rotatable lumbar support adjustment device 102 (shown in FIG. 11).

Figure 21:
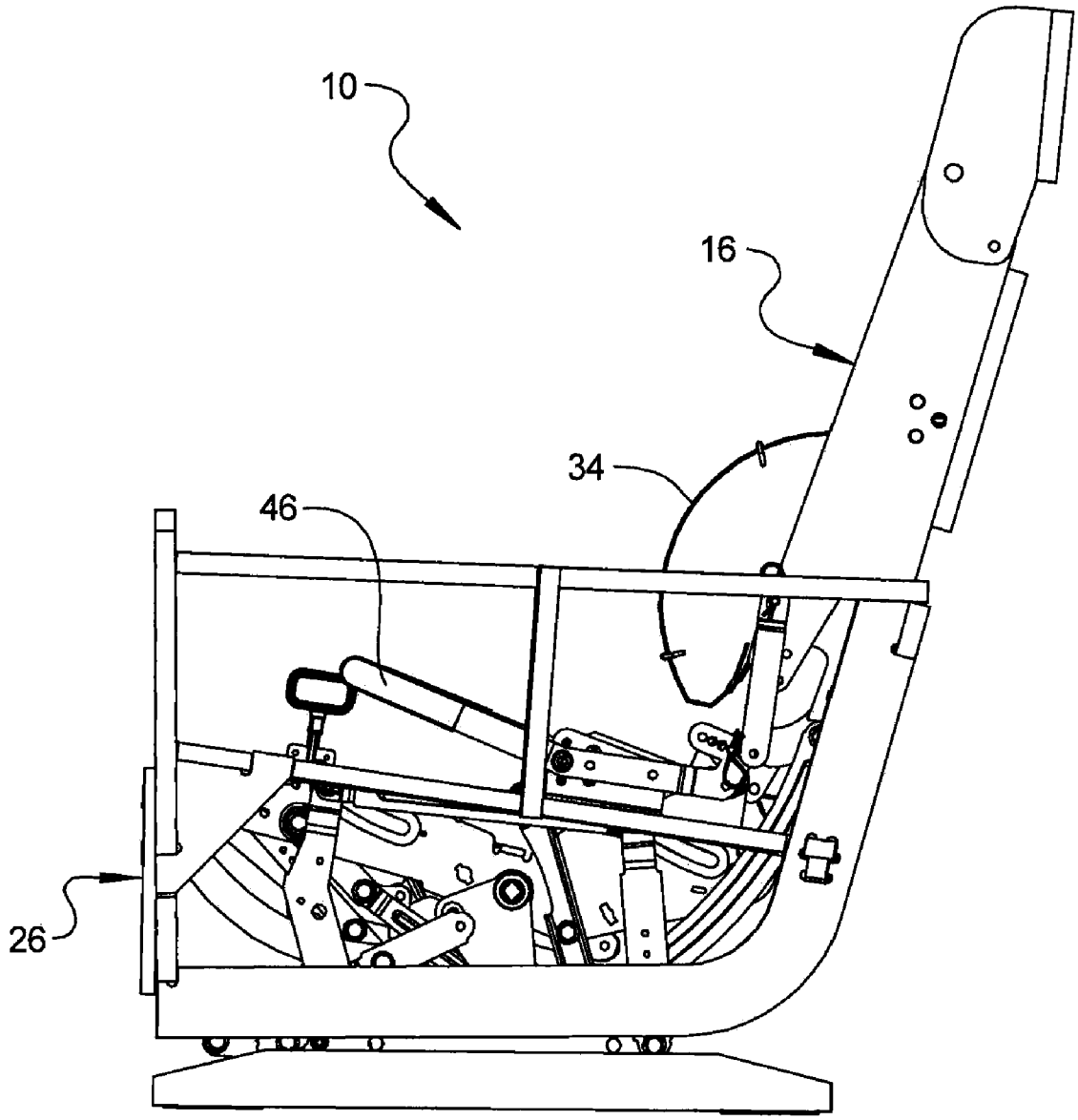
FIG. 21 is a left side elevational view of the furniture member of FIG. 1 showing the lumbar support adjustment device in a neutral position.

Referring to FIG. 21, furniture member 10 is shown with back seat member 16 in a fully upright position and leg rest assembly 26 in a fully retracted position. Adjustment device handle 46 is shown in the neutral position therefore providing an intermediate or neutral position for each of the lumbar support members 34.

Figure 22:
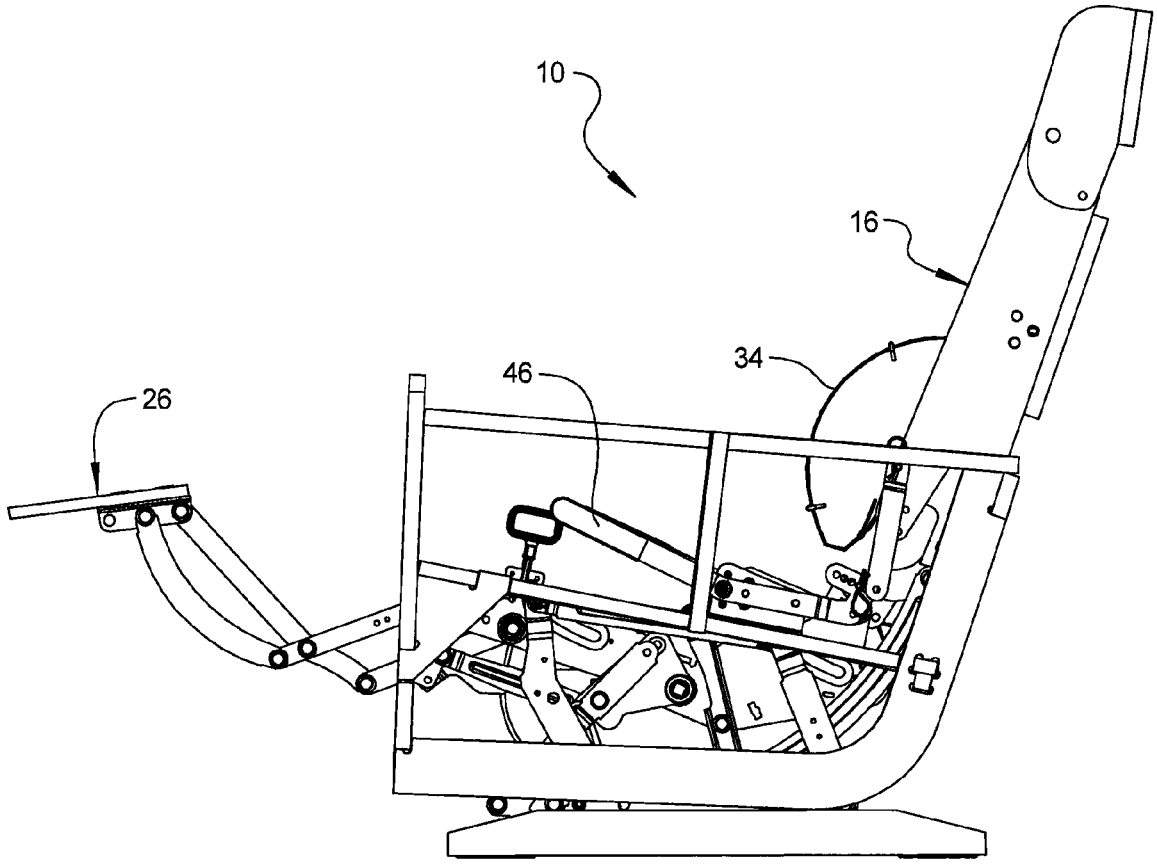
FIG. 22 is the left side elevational view of the furniture member of FIG. 1 showing the leg rest assembly in a fully extended position.

Referring now to FIG. 22, leg rest assembly 26 can be fully extended to the position shown with back seat member 16 retained in the fully upright position without impacting the position of adjustable device handle 46. Therefore, lumbar support members 34 can be retained in the neutral support position shown (or in whatever position they are directed to by adjustment device handle 46) during extension or retraction of leg rest assembly 26.

Figure 23:
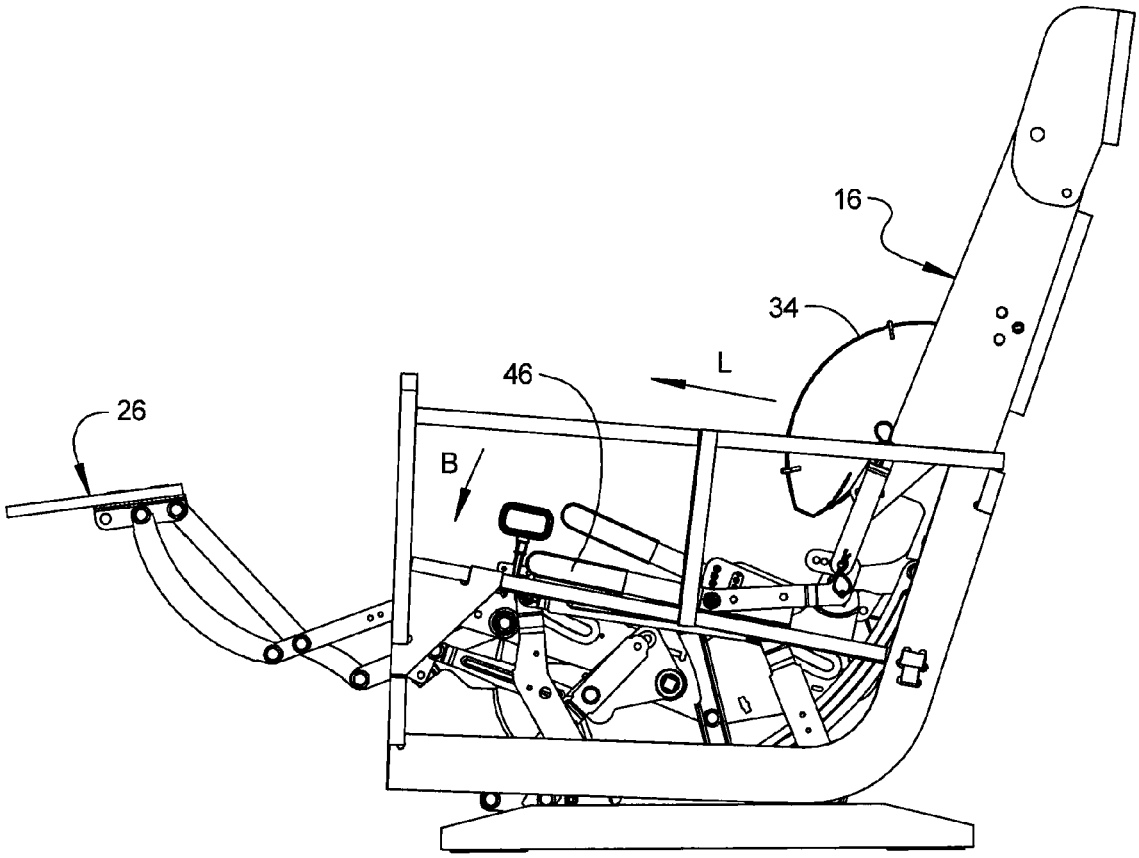
FIG. 23 is the left side elevational view of the furniture member of FIG. 22 showing the lumbar support adjustment device positioned for maximum support.

Referring to FIG. 23, with leg rest assembly 26 in the fully extended position and back seat member 16 still in the fully upright position, lumbar support members 34 can be extended to the maximum lumbar support position by rotation of adjustment device handle 46 in the maximum lumbar support adjustment direction "C". This displaces each of the lumbar support members 34 to the left or in the lumbar support maximizing direction "L" previously described. The positions of back seat member 16 and leg rest assembly 26 are not effected by adjustment of the lumbar support members 34.

Figure 24:
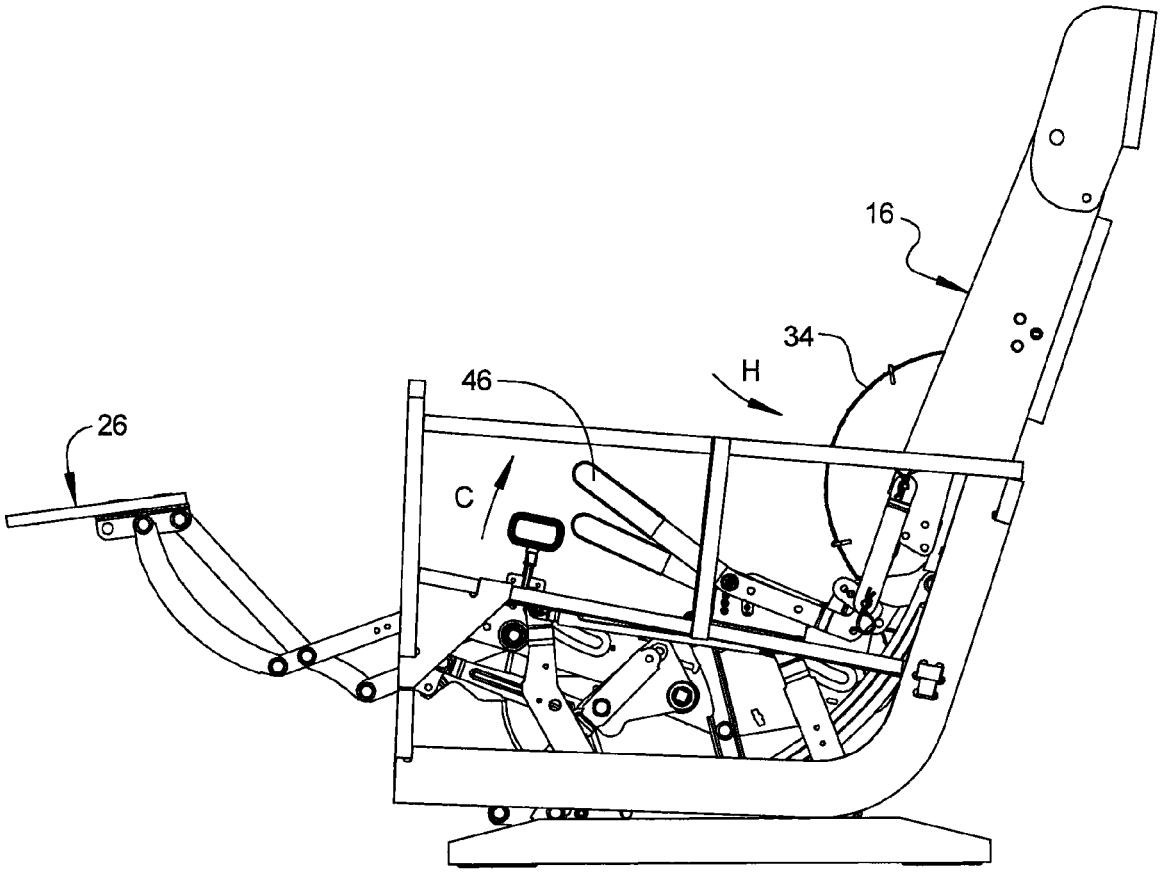
FIG. 24 is the left side elevational view of the furniture member of FIG. 22 showing the lumbar support adjustment device positioned for reduced support.

Referring to FIG. 24, again with the leg rest assembly 126 in the fully extended position and back seat member 16 retained in the fully upright position, the lumbar support members 34 can be moved to the reduced lumbar support position by rotation of adjustment device handle 46 in the reduced lumbar support adjustment direction "C". This rotation of adjustment device handle 46 displaces of the lumbar support members 34 in the lumbar support reduction direction "H". The positions of back seat member 16 are not effected by adjustment of the lumbar support members 34. Leg rest member or assembly 26 is connected to the mechanism 22 and is therefore extendable within a range bounded by the fully retracted position and the fully extended position, without altering any one of the plurality of support positions of the lumbar support members 34.

Figure 25:
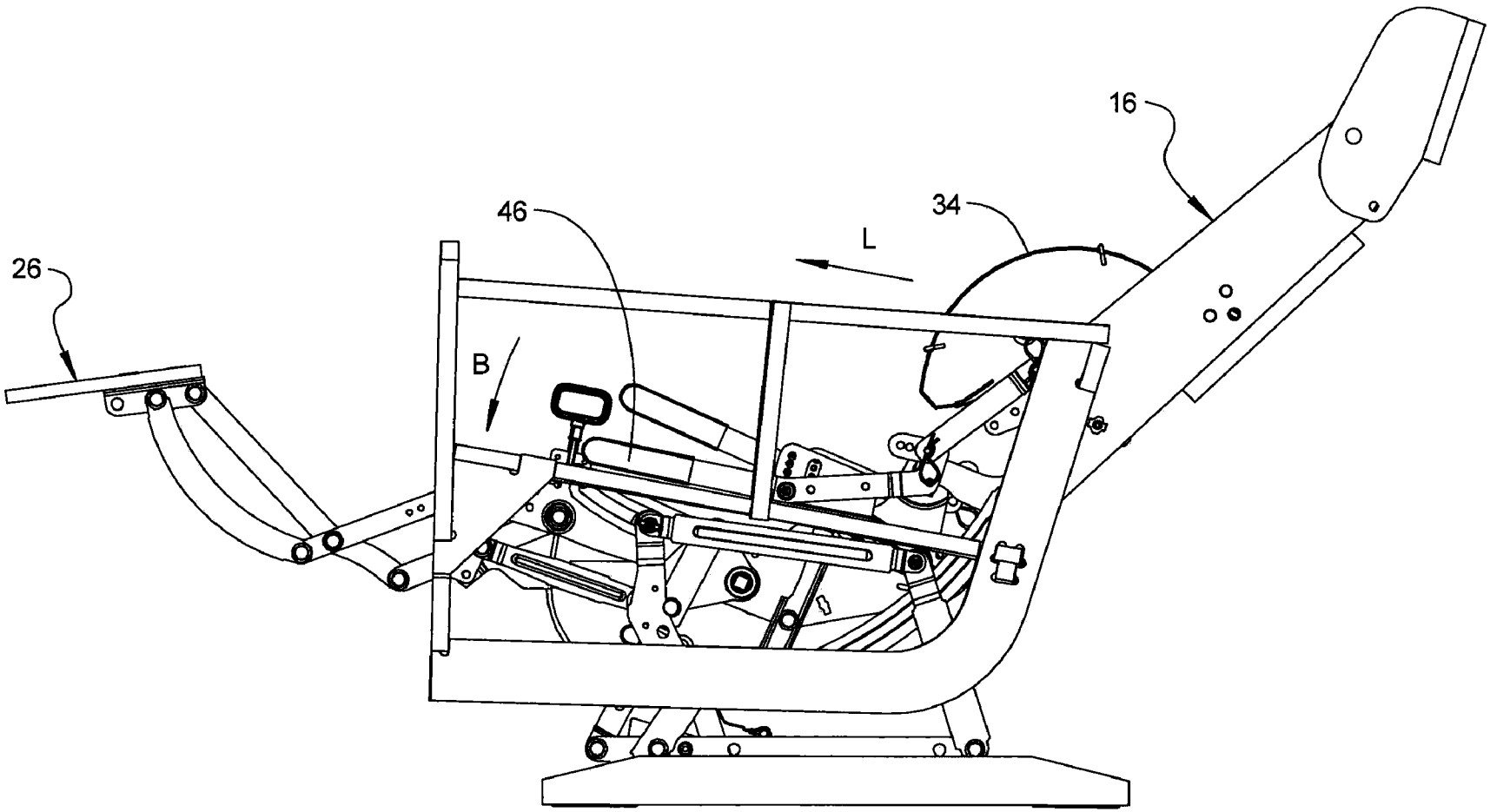
FIG. 25 is the left side elevational view of the furniture member of FIG. 23 further showing the back seat member in a fully reclined position.

Referring to FIG. 25, leg rest assembly 26 is shown in the fully extended position and back seat member 16 is shown in a fully reclined position. By rotating adjustment device handle 46 from the neutral position to the maximum lumbar support adjustment direction "B", each of the lumbar support members 34 are extended in the lumbar support maximizing direction "L". As previously noted, the selected positions of back seat member 16 and leg rest assembly 26 are not effected by adjustment of the lumbar support members 34.

Figure 26:
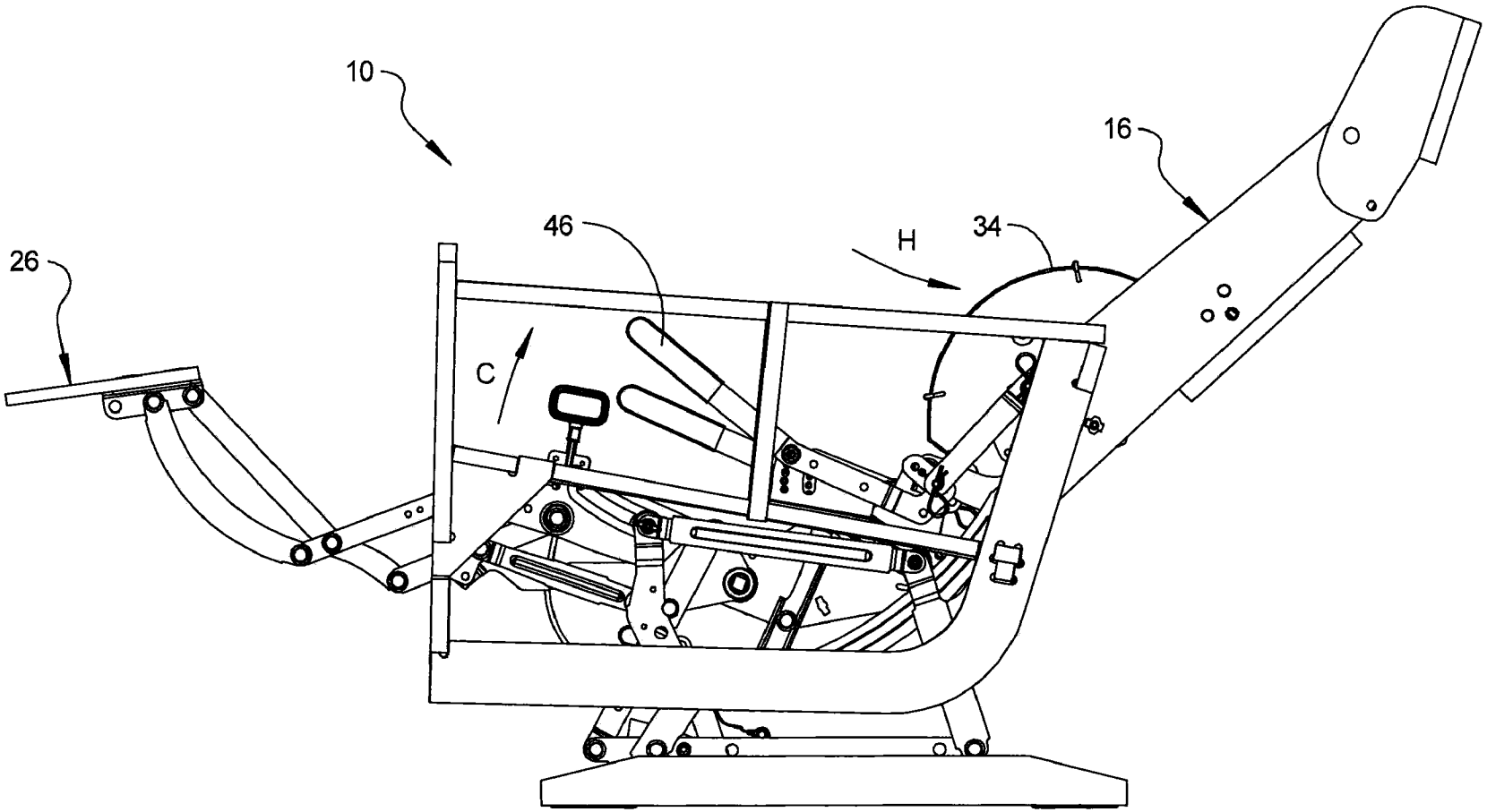
FIG. 26 is the left side elevational view of the furniture member of FIG. 24 further showing the back seat member in a fully reclined position.

Referring to FIG. 26, again the leg rest assembly 26 is shown in the fully extended position and the back support member 16 is shown in the fully reclined position. Each of the lumbar support members 34 can be repositioned to provide reduced lumbar support by rotating adjustment device handle 46 from the neutral position in the reduced lumbar support adjustment direction "C". This displaces each of the lumbar support members 34 in the lumbar support reduction direction "H" to reduce or minimize the amount of lumbar support provided to the occupant of furniture member 10.

Figure 27:
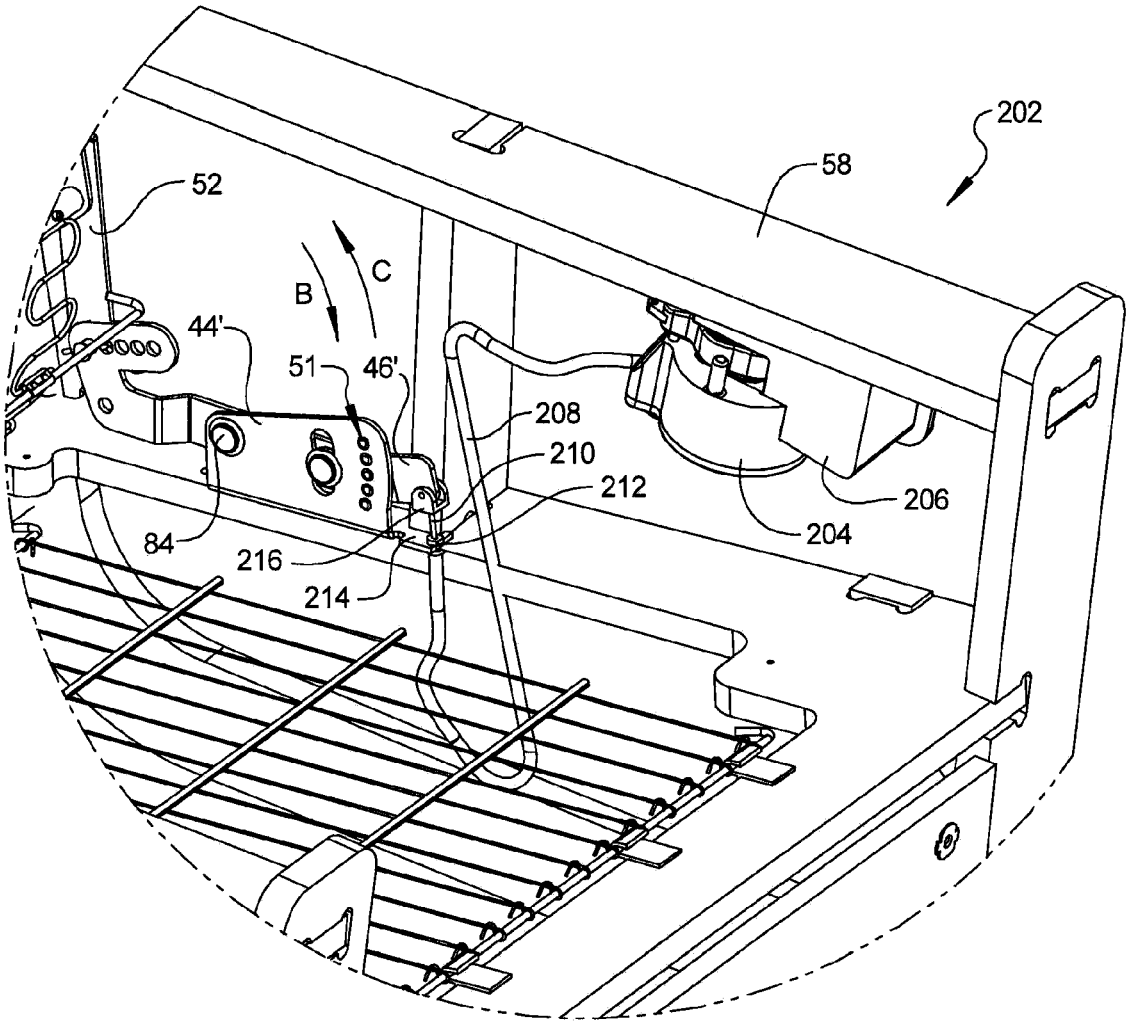
FIG. 27 is a right front perspective view of another embodiment of a drive mechanism to control lumbar support.

Referring to FIG. 27 and again to FIG. 2, according to further embodiments a furniture member 202 is modified from furniture member 10 to include a force multiplying drive mechanism 204 used to supplement direct manual control of adjustment device handle 46 to control a degree of lumbar support for furniture member 202. Drive mechanism 204 is connected to a housing 206 which can be connected to arm rest member 58. A flexible sheath 208 extends from drive mechanism 204 having an internally disposed, sliding wire member 210. A stop member 212 connects an end of flexible sheath 208 to a bracket extension 214 defining an extension of a modified bracket 44'. Wire member 210 is connected to a rotatable connector 216 which is in turn rotatably connected to a modified adjustment device handle 46', which is modified to shorten handle grip end 106 and eliminate the handle grip 104 which are both shown and described in reference to FIG. 11.

Wire member 210 is slidably displaced within flexible sheath 208 by actuation of drive mechanism 204 such that wire member 210 extends or retracts with respect to flexible sheath 208 to displace modified adjustment device handle 46' in either of the maximum lumbar support adjustment direction "B" or the reduced lumbar support adjustment direction "C". Modified adjustment device handle 46' rotates using handle connecting pin 84 to displace actuation link 52 as previously described herein in reference to FIG. 4. Because force multiplying drive mechanism 204 operates to incrementally move wire member 210, the plurality of detent settings 51 can be eliminated at the manufacturer's discretion from this embodiment to provide a greater degree of angular control of modified adjustment device handle 46' rotation.

Figure 28:
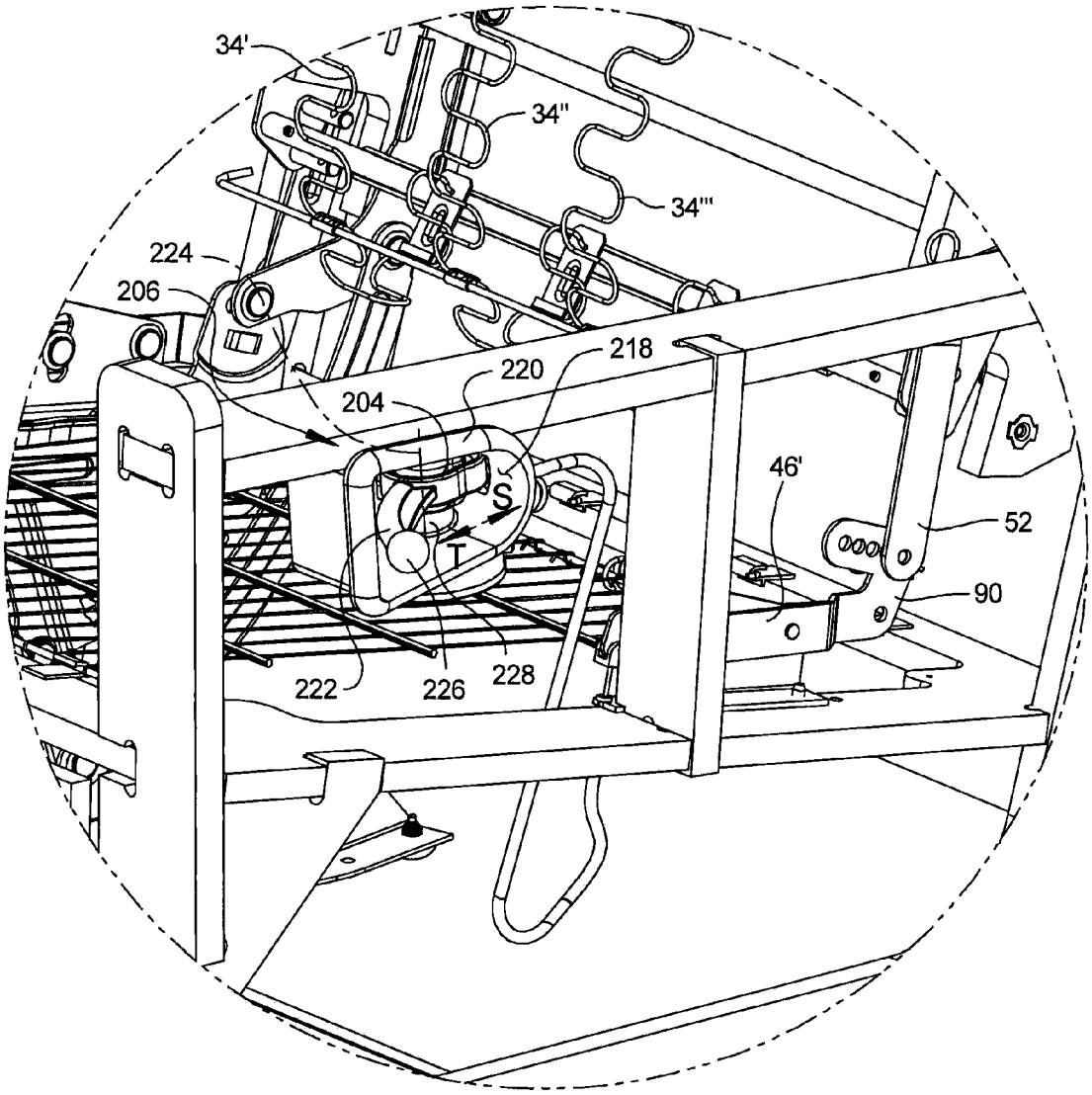
FIG. 28 is a left front perspective view of the drive mechanism of FIG. 27.

Referring to FIG. 28, drive mechanism 204 is coupled to housing 206 within a cavity 218 of housing 206. Housing 206 can be a molded polymeric member having an escutcheon or face plate 220 either homogenously or mechanically connected to housing 206 forming a rounded surface. Drive mechanism 204 includes a rotatable handle 222 which is rotatable about a rotational axis 224 of drive mechanism 204. Handle 222 can include a hand grip feature 226 to assist in manually rotating handle 222 in either of a first direction "S" or an opposed second direction "T". Full displacement of handle 222 within cavity 218 defines only a portion of displacement travel for wire member 210, therefore rotation of handle 222 is aided by a force multiplying capability of drive mechanism 204. Displacement of handle 222 causes rotation of modified adjustment device handle 46' which displaces link connecting end 90 and therefore displaces rotatably connected actuation link 52 to adjust the position of lumbar support members 34', 34", and 34'" as previously described herein.

Figure 29:
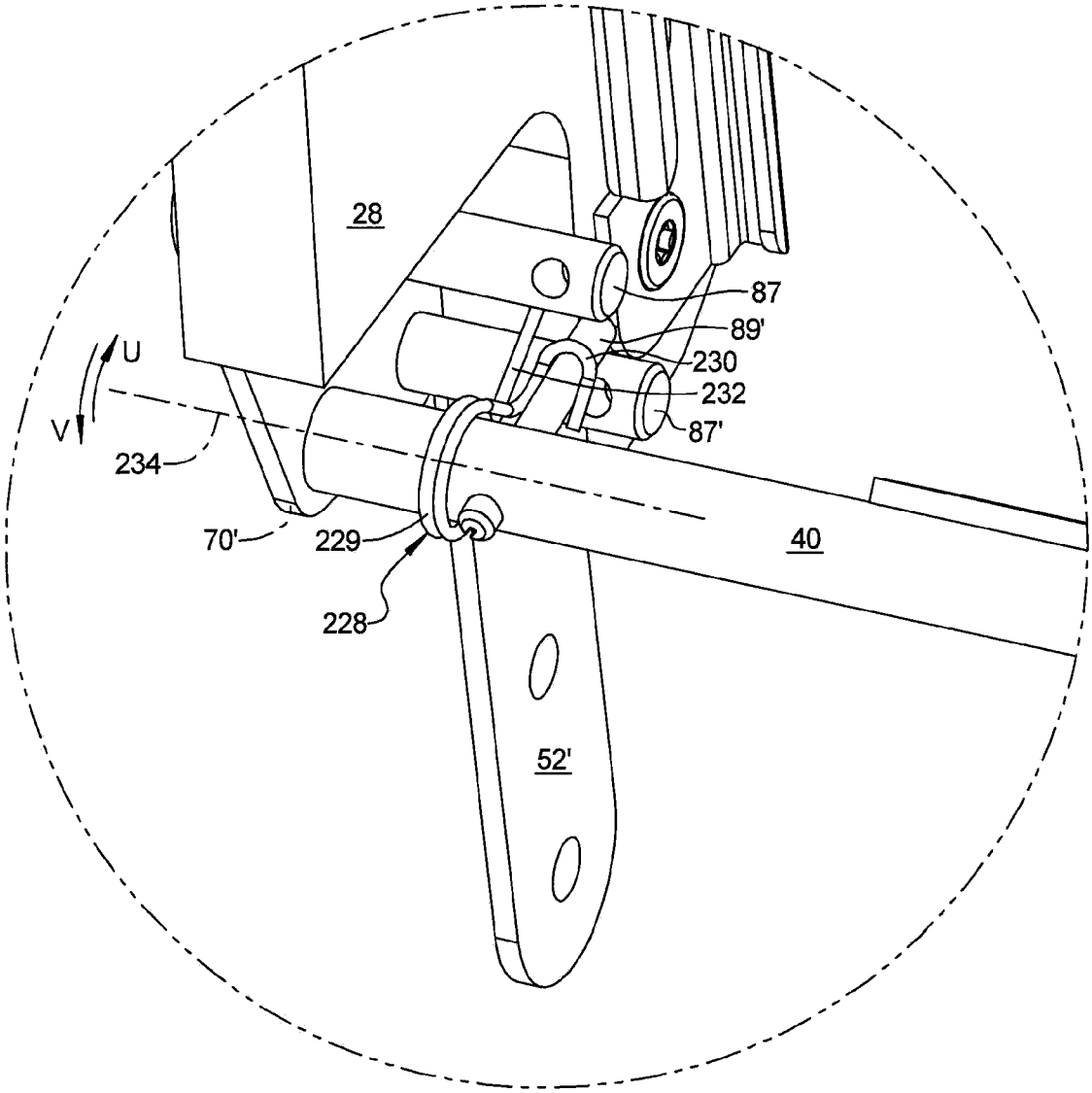
FIG. 29 is a side elevational view of area 29 of FIG. 4 modified to show a torsion spring applied to bias the second pivot tube.

Referring to FIG. 29, second pivot tube 40 can be biased to help retain fastener 89' in normal contact with fourth contact pin 87', and therefore to provide a bias force which must be overcome to rotate second pivot tube 40. This bias force can be created by use of a bias member 228, such as a torsion spring made from a spring steel. Bias member 228 has a body portion 229 which is looped about second pivot tube 40, a first leg 230 defining a loop which contacts fastener 89', and a second leg 232 which contacts third contact pin 87. Fastener 89' is therefore biased into contact with fourth contact pin 87'. Second pivot tube 40 is therefore induced to rotate about a longitudinal axis 234 in a rotational arc "U" by bias member 228 whenever fastener 89' is not in contact with fourth contact pin 87'. Second pivot tube 40 can rotate about an opposite arc of rotation "V" with respect to longitudinal axis 234 until fastener 89' contacts third contact pin 87. Referring again to FIG. 4, bias members 228 can similarly be positioned (not shown) in looped relationship about first pivot tube 38, with first leg 230 in contact with fastener 89, and with second leg 232 in contact with second contact pin 85' to bias fastener 89 into contact with first contact pin 85.

Figure 30:
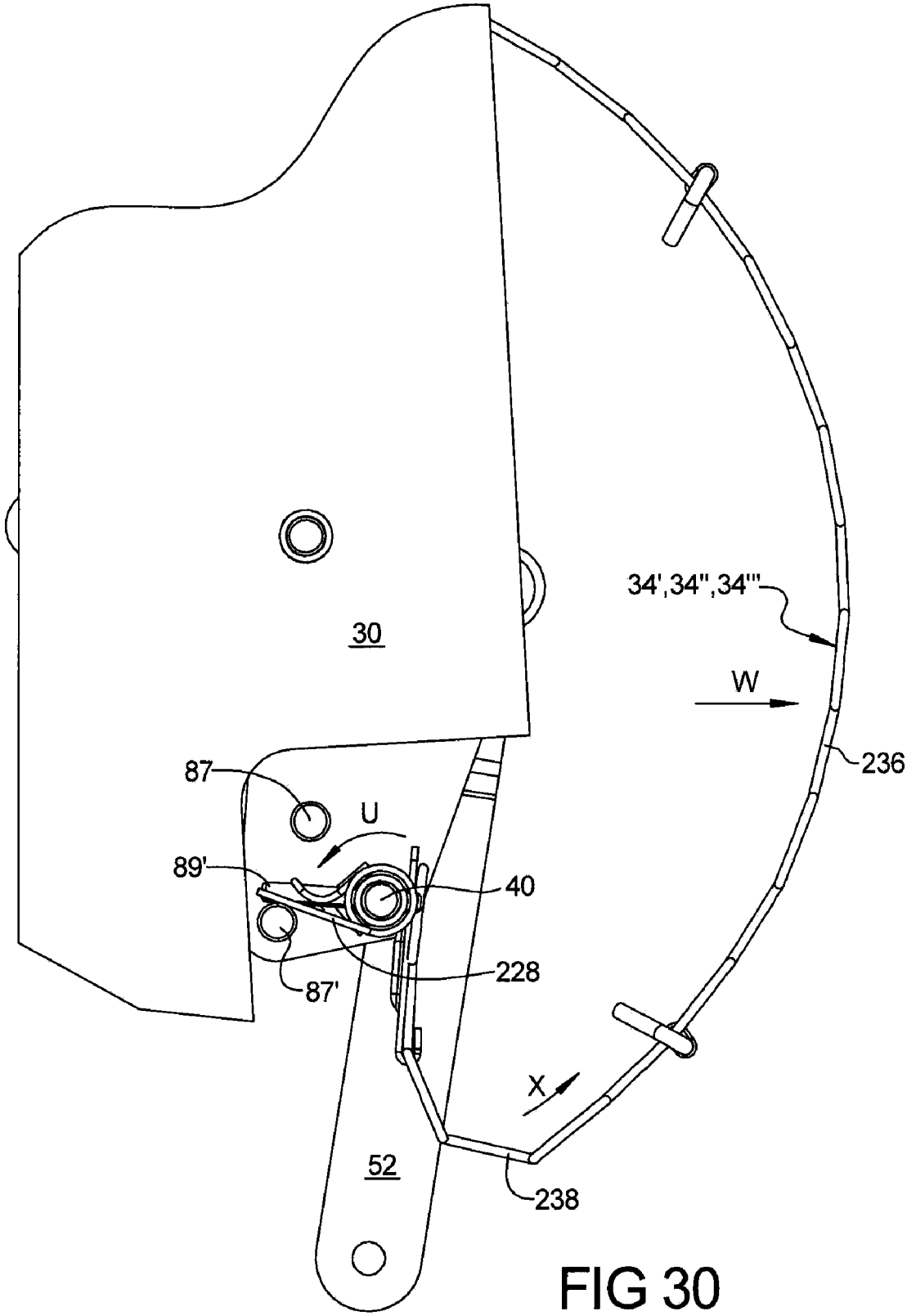
FIG. 30 is a partial right side elevational view of the back support member of FIG. 4.

Referring to FIG. 30, a normal extended position of lumbar support members 34', 34", and 34'" is shown in a first rotated position of second pivot tube 40, with a main support section 236 of each maximally extended in a direction "W", or forward toward an occupant. A doubled over end 238 of lumbar support members 34', 34", and 34'" is extended in a direction "X". Second pivot tube 40 is rotated in the arc of rotation "U" by bias member 228 so that fastener 89' is in contact with fourth contact pin 87'.

Figure 31:
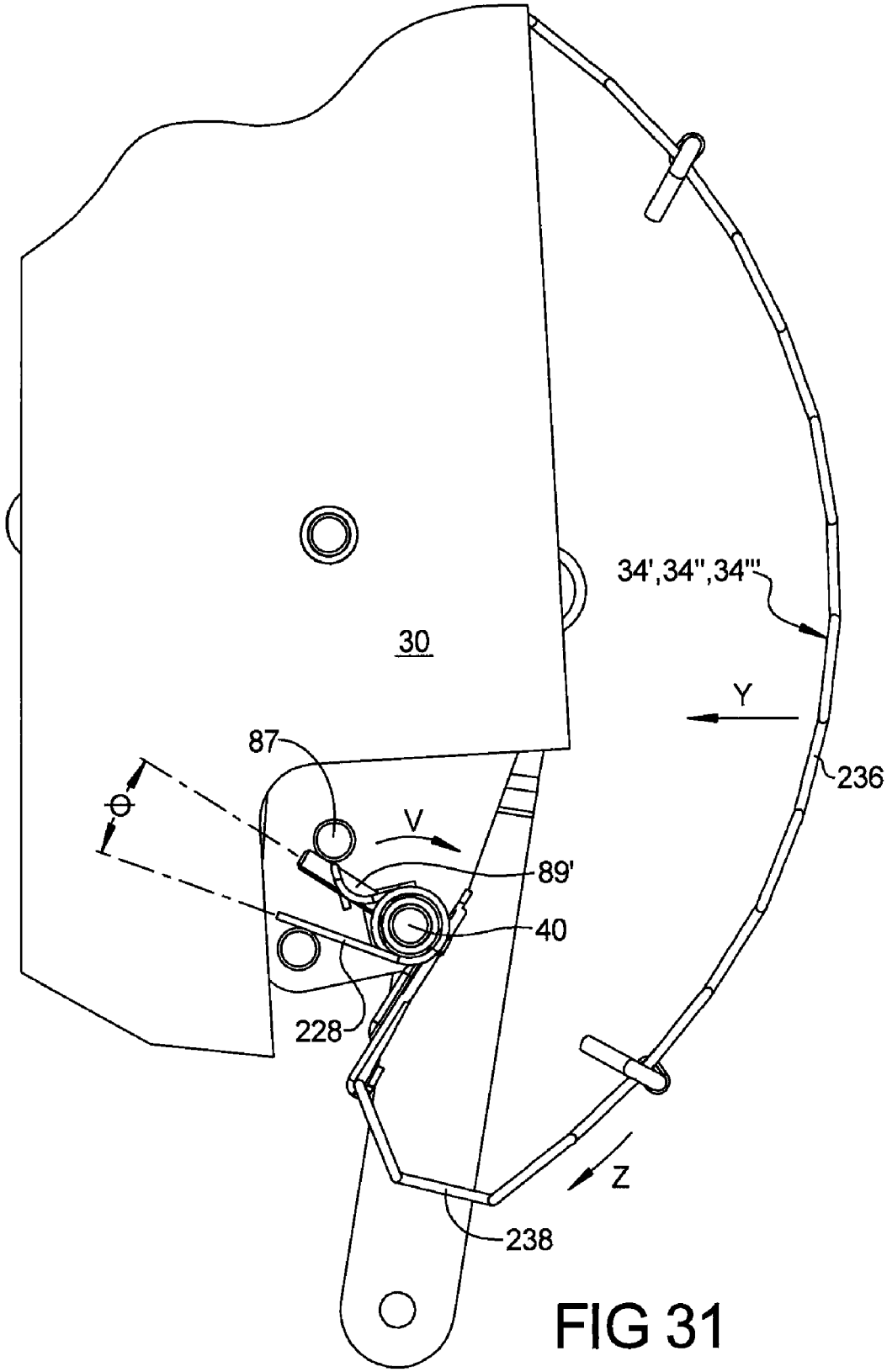
FIG. 31 is a partial right side elevational view modified from FIG. 30.

Referring to FIG. 31, the reduced or minimally extended position of lumbar support members 34', 34", and 34'" is shown in a second rotated position of second pivot tube 40, with the main support section 236 of each retracted from the position shown in FIG. 30 in a compression direction "Y", or away from the lumbar area of the occupant. The doubled over end 238 of lumbar support members 34', 34", and 34'" is compressed and moves downwardly in a direction "X". Synchronous rotation of second pivot tube 40 about arc of rotation "V" occurs when the bias force of bias member 228 is overcome, and is stopped by contact between fastener 89' and third contact pin 87. The bias force of bias member 228 will thereafter return lumbar support members 34', 34", and 34'" to the position shown in FIG. 30 if the occupant weight is reduced, or if rotation of back support member 16 permits the bias force of bias member 228 to override the force holding lumbar support members 34', 34", and 34'" in the position shown.

A furniture member lumbar support system of the present disclosure provides several advantages. A manually displaceable adjustment device handle which is linked to a pivot tube is used to displace lumbar support members between a reduced or minimum support position to a neutral support position and out to a maximum support position. The adjustment device assembly has detent devices to permit the handle to be releasably retained in a plurality of positions between and including maximum, neutral, and minimum lumbar support positions. The adjustment device handle is positioned between an operator seated on the furniture member and an arm rest of the furniture member so that the handle can be reached and actuated by an occupant without requiring an additional mechanism to position the handle outward of the arm rest assembly. Either an upper or a lower pivot tube can be connected to the handle which is rotatable to displace the lumbar support members. A seat pan of the furniture member of the present disclosure can also have an elastically deflectable member attached to the seat pan or the seat pan itself can include homogenously extending elastically deflectable members such that the weight of an occupant can be accommodated upwardly and downwardly without interfering with operation of the adjustment device handle. The lumbar support system of the present disclosure is also operable during and within any operating condition of the furniture member, including during extension or retraction of a leg rest assembly or during rotation of a back seat member between a fully upright and a fully reclined position. The lumbar support system of the present disclosure can therefore be operated to manually adjust the amount of occupant lumbar support in any position of the furniture member.

What is claimed is:

1. A lumbar support system for a furniture member, comprising:

a furniture member having a back seat member including first and second opposed wings connected to an occupant support base member; and a lumbar support system connected to the furniture member, the lumbar support system including:

first and second pivot tubes individually rotatably connected to both the first and second opposed wings of the back seat member;

at least one flexible occupant lumbar support member connected to each of the first and second pivot tubes;

a lumbar support adjustment device operating to rotate one of the first and second pivot tubes to selectively deflect the at least one lumbar support member to any one of a plurality of support positions; and the at least one lumbar support member displaceable by rotation of the one of the first and second pivot tubes to any of the plurality of support positions, the first and second pivot tubes being further axially rotatable by displacement of the at least one lumbar support member from the weight of an occupant acting independently of operation of the lumbar support adjustment device.

2. The lumbar support system of claim 1, wherein the plurality of support positions includes at least a neutral support position, a maximum support position with the at least one flexible occupant lumbar support member arched away from the back seat member, and a reduced support position with the at least one flexible occupant lumbar support member retracted toward the back seat member.

3. The lumbar support system of claim 2, wherein the lumbar support adjustment device includes a manually rotatable handle pivotable about a rotation axis to selectively position the at least one flexible occupant lumbar support member in any one of the neutral support position, the maximum support position, and the reduced support position.

4. The lumbar support system of claim 3, wherein the manually rotatable handle is positioned between an occupant of the furniture member positioned on the base member and an arm assembly of the base member.

5. The lumbar support system of claim 1, wherein the at least one flexible occupant lumbar support member comprises a sinuous wire spring.

6. The lumbar support system of claim 5, further comprising a first clip member fixedly connected to the first pivot tube and a second clip member fixedly connected to the second pivot tube, the sinuous wire spring connected to the first and second clip member, the sinuous wire spring displaceable by rotation of the first and second pivot tubes to any of the support positions.

7. The lumbar support system of claim 1, further comprising a mechanism connected to the base member, the back seat member connected to the mechanism to permit the back seat member to rotate with respect to the base member within a range bounded by an upright position and a fully reclined position without altering any one of the plurality of support positions of the least one flexible occupant lumbar support member.

8. The lumbar support system of claim 7, further comprising a leg rest member connected to the mechanism and extendable within a range bounded by a fully retracted position and a fully extended position, without altering any one of the plurality of support positions of the least one flexible occupant lumbar support member.

9. The lumbar support system of claim 1, wherein the back seat member includes opposed first and second arms, the first and second pivot tubes being horizontally positioned between the first and second arms and oriented substantially transverse to the first and second arms.

10. The lumbar support system of claim 1, wherein the lumbar support system further includes:

a bracket connected to the base member having a plurality of detent features created on the bracket;

a handle pivotally pinned to the bracket; and a detent member connected to the handle and biased into contact with a selectable one of the plurality of detent features, each of the plurality of detent features defining individual ones of the plurality of support positions, the handle pivotable to releasably position the detent member into contact with the selectable one of the plurality of detent features.

11. The lumbar support system of claim 1, wherein the lumbar support adjustment device connected to the at least one pivot tube operates to axially rotate the at least one pivot tube.

12. The lumbar support system of claim 1, wherein the lumbar support adjustment device connected to the at least one pivot tube operates to pivotally rotate the at least one pivot tube.

13. The lumbar support system of claim 1, wherein the lumbar support adjustment device comprises:

a flexible sheath;

a wire member slidably disposed within the flexible sheath;

a manually actuated force multiplying drive mechanism including a handle manually rotatable such that a full displacement of the handle defines only a portion of displacement travel for the wire member within the flexible sheath; and an adjustment device handle linked to the at least one pivot tube operable to rotate the at least one pivot tube by displacement of the wire member.

14. The lumbar support system of claim 13, wherein the lumbar support adjustment device further comprises a rotatable connector fixedly receiving the wire member and rotatably connected to the adjustment device handle.

15. A lumbar support system for a furniture member, comprising:

a furniture member having a back seat member including first and second opposed wings connected to an occupant support base member; and a lumbar support system connected to the furniture member, the lumbar support system including:

at least one pivot tube rotatably connected to each of the first and second opposed wings of the back seat member;

at least one flexible occupant lumbar support member connected to the at least one pivot tube;

a lumbar support adjustment device connected to the at least one pivot tube operating to rotate the at least one pivot tube to selectively deflect the at least one lumbar support member to any one of a plurality of support positions;

first and second contact pins positioned at each of the first and second opposed wings proximate to the at least one pivot tube and oriented substantially parallel to the at least one pivot tube; and a fastener extending transversely from the at least one pivot tube and rotatable with the at least one pivot tube, the fastener positioned in contact with the first contact pin in a first rotated position of the at least one pivot tube and positioned in contact with the second contact pin in a first rotated position of the at least one pivot tube, the first and second contact pins defining a range of rotation of the at least one pivot tube.

16. The lumbar support system of claim 15, further including a bias member in contact with the at least one pivot tube and having a first member in contact with one of the first or second contact pins and a second member in contact with the fastener, the bias member adapted to bias the fastener into contact with the other one of the first or second contact pins.

17. A lumbar support system for a furniture member, comprising:

first and second pivot tubes rotatably connected to a back seat member of the furniture member;

a plurality of sinuous wire springs all having ends connected to the first pivot tube and opposite ends all connected to the second pivot tubes;

the back seat member including opposed support wings having the first and second pivot tubes oriented horizontally and substantially transverse to the opposed support wings;

a manually rotatable device positioned between an occupant of the furniture member and an arm assembly of the furniture member; and a linkage set coupling the manually rotatable device to a predetermined one of the first and second pivot tubes so that rotation of the manually rotatable device operates to rotate the predetermined one of the first and second pivot tubes to displace the plurality of sinuous wire springs between any one of a plurality of occupant lumbar support positions.

18. The lumbar support system of claim 17, wherein the furniture member includes the back seat member connected for rotation to a base member.

19. The lumbar support system of claim 17, wherein the manually rotatable device includes:

a bracket connected to the base member having a plurality of detent features created on the bracket; and a handle rotatably connected to the bracket.

20. The lumbar support system of claim 19, wherein the manually rotatable device further includes a detent member connected to the handle and biased into contact with a selectable one of the plurality of detent features, each of the plurality of detent features equating to individual ones of the plurality of support positions, the handle rotatable to releasably position the detent member into contact with the selectable one of the plurality of detent features.

21. A lumbar support system for a furniture member, comprising:

first and second pivot tubes rotatably connected to a back seat member of the furniture member;

a plurality of sinuous wire springs connected to each of the first and second pivot tubes each configured in an arc positioned to support a lumbar area of an occupant of the furniture member;

a manually rotatable device connected to an arm assembly of the furniture member and positioned for free rotation;

a linkage set coupling the manually rotatable device to a predetermined one of the first and second pivot tubes so that rotation of the manually rotatable device operates to rotate the predetermined one of the first and second pivot tubes to displace the plurality of sinuous wire springs between any one of a plurality of occupant lumbar support positions; and a seat pan connected to a base member of the furniture member, the base member further including the arm assembly, the seat pan including a flexible occupant support member positioned within an aperture of the seat pan, the occupant support member operating to deflect from a weight of the occupant; and the connecting bracket fastenably connected to a seat pan support surface of the seat pan such that an adjustment device handle of the manually rotatable device is positioned between an occupant seated on the seat pan and an arm rest support member of an arm rest member of the arm assembly.

22. The lumbar support system of claim 21, further including a plurality of wires connected to create an occupant support member connected to the seat pan.

23. The lumbar support system of claim 22, wherein the occupant support member includes a plurality of clips including a first portion, and a second portion connected to the seat pan, the wire frame being directly connected to the first portion of the plurality of clips.

24. The lumbar support system of claim 23, wherein the occupant support member includes a plurality of biasing members connected between the wire frame and the second portion of the plurality of clips, the biasing members adapted to permit deflection of the wire frame with respect to the seat pan without interference of the wire frame or the biasing members with the manually rotatable device.

25. The lumbar support system of claim 21, wherein the seat pan includes a first plurality of flexible fingers homogenously connected to the seat pan and extending in a first direction partially across an aperture of the seat pan.

26. The lumbar support system of claim 25, wherein the seat pan includes a second plurality of flexible fingers homogenously connected to the seat pan, individual ones of the second plurality interspersed between proximate ones of the first plurality of flexible fingers, the second plurality of flexible fingers extending in a second direction opposite to the first direction and partially across the aperture of the seat pan;

wherein elastic deflection of the first and second plurality of fingers from the weight of the occupant occurs without interference of any of the flexible fingers with the manually rotatable device.

27. A lumbar support system for a furniture member, comprising:

a furniture member having a back seat member including opposed arms, the back seat member connected to a base member; and a lumbar support system including:

first and second pivot tubes horizontally and transversely oriented and rotatably connected to the opposed arms of the back seat member;

a plurality of flexible occupant lumbar support members all having ends fixedly connected to the first and opposite ends all connected to the second pivot tubes;

a lumbar support adjustment device connected to a predetermined one of the pivot tubes operating to rotate the predetermined one of the pivot tubes to selectively position the at least one lumbar support member in any one of a plurality of support positions, the lumbar support adjustment device including:

a bracket connected to the base member having a plurality of detent features created on the bracket; and a handle rotatably connected to the bracket, the handle connected to the predetermined one of the pivot tubes by a linkage set, the handle operating to rotate the predetermined one of the pivot tubes and displace the plurality of flexible occupant lumbar support members to a furniture member occupant desired position.

28. The lumbar support system of claim 27, wherein the linkage set includes:

an actuation link rotatably connected to the handle; and first and second pivot tube rotation brackets, the predetermined one of the pivot tubes having opposed first and second ends, each of the first and second pivot tube rotation brackets non-rotatably connected to one of the first and second ends, one of the first and second pivot tube rotation brackets rotatably connected to the actuation link, and each of the first and second pivot tube rotation brackets being rotatably connected to different ones of the opposed arms of the back seat member.

29. The lumbar support system of claim 28, further including a third pivot tube horizontally oriented and rotatably connected to the opposed arms of the back seat member.

30. The lumbar support system of claim 29, further including a pin connecting each of the first and second pivot tube rotation brackets to first and second ends of the third pivot tube, the third pivot tube defining an axis of rotation of the first and second pivot tube rotation brackets and the predetermined one of the pivot tubes.

31. The lumbar support system of claim 27, wherein the handle further includes a handle grip end and an opposed link connecting end, the link connecting end rotatably pinned to the linkage set.

32. The lumbar support system of claim 31, further including a spin rivet rotatably connecting the handle to the bracket positioned between the handle grip end and the link connecting end to permit a pivoting motion of the handle.

33. The lumbar support system of claim 27, wherein the back seat member is rotatably coupled to the base member by a mechanism for operation between a fully upright and a fully reclined position without impacting the furniture member occupant desired position of the flexible occupant lumbar support members.

34. The lumbar support system of claim 27, wherein the linkage set includes:

an actuation link rotatably connected to the handle; and a pivot link non-rotatably connected to the predetermined one of the pivot tubes and rotatably connected to the actuation link.

* * * * *